US008340567B2

(12) United States Patent
Katayama

(10) Patent No.: US 8,340,567 B2
(45) Date of Patent: Dec. 25, 2012

(54) PRINTING APPARATUS AND TRAY CONTROL METHOD OF THE SAME

(75) Inventor: Hiroshi Katayama, Matsumoto (JP)

(73) Assignee: Seiko Epson Corproration, Tokyo (JP)

( * ) Notice: Subject to any disclaimer, the term of this patent is extended or adjusted under 35 U.S.C. 154(b) by 541 days.

(21) Appl. No.: 12/554,824

(22) Filed: Sep. 4, 2009

(65) Prior Publication Data

US 2010/0061787 A1 Mar. 11, 2010

(30) Foreign Application Priority Data

Sep. 5, 2008 (JP) ..... 2008-228748

(51) Int. Cl.
*G03G 15/00* (2006.01)

(52) U.S. Cl. ..... 399/405; 399/393

(58) Field of Classification Search ..... 399/405
See application file for complete search history.

(56) References Cited

U.S. PATENT DOCUMENTS 4,811,049 A * 3/1989 Honjo et al. ..... 399/374
5,253,029 A 10/1993 Kang
6,148,722 A * 11/2000 Hagstrom ..... 101/35
6,305,281 B1 * 10/2001 Aizawa ..... 101/118
7,237,857 B2 * 7/2007 Chang ..... 347/2
7,260,041 B2 * 8/2007 Ezawa et al. ..... 369/53.2
7,410,164 B2 * 8/2008 Koide et al. ..... 271/213
7,448,619 B2 * 11/2008 Kuwata et al. ..... 271/213
7,591,552 B2 * 9/2009 Takeshita et al. ..... 347/104

FOREIGN PATENT DOCUMENTS

JP 05-212932 A 8/1993
JP 2000-099214 A 4/2000
JP 2005-059584 A 3/2005

* cited by examiner

*Primary Examiner* — Anthony Nguyen
(74) *Attorney, Agent, or Firm* — Kilpatrick Townsend & Stockton LLP

(57) ABSTRACT

Provided is a printing apparatus which includes a tray for setting a printing medium thereon, the printing apparatus including: a switch section which is used to perform a power-on operation or a power-off operation; a tray driving section which performs a driving operation of extracting the tray; a detection section which detects whether the printing medium exists on the tray; a control section which moves the tray to a discharge position by controlling the tray driving section in order to prompt an operation of extracting the printing medium from the tray before an initialization process ends when the printing medium is detected upon performing a power-on process; and a storage section which stores information that the control section moves the tray to the discharge position upon performing the power-on process.

6 Claims, 12 Drawing Sheets

ACCOMMODATION POSITION

SET POSITION

PRINTING STANDBY POSITION

PRINTING APPARATUS AND TRAY CONTROL METHOD OF THE SAME

This application claims priority to Japanese Patent Application No. 2008-228748, filed Sep. 5, 2008, the entirety of which is incorporated by reference herein.

BACKGROUND

1. Technical Field

The present invention relates to a printing apparatus which includes a tray for setting a printing medium thereon, and more particularly, to a printing apparatus which performs an initialization process upon turning on the printing apparatus and a tray control method of the same.

2. Related Art

In recent years, photograph data obtained by a digital camera or image (moving picture) data and voice data obtained by a video camera have been generally written in an optical disk to be stored therein. For example, JP-A-2005-59584 discloses a printer which is capable of printing a title, an image, or the like on a label surface of the optical disk so as to promptly understand the contents of the images or photographs stored in the optical disk. The printer includes a tray which sets the optical disk thereon, and the tray is adapted to move in such a manner that a transport roller rotates by nipping the tray. Also, JP-A-2005-59584 discloses a technology for protecting the disk in such a manner that the transport roller nips the disk placed on the tray.

In the printer disclosed in JP-A-2005-59584, when a push signal (power-on signal) of a power switch (power SW) is input in a power-off state, a current position of the tray is determined. When the current position of the tray is an accommodation position or a front end portion adjusting position (standby position), the tray moves to a discharge position. On the other hand, when the current position of the tray is the discharge position, the tray moves to the accommodation position in the case where the disk does not exist on the tray, and the tray moves to the front end portion adjusting position in the case where the disk exists on the tray. In addition, when the push signal of the power switch is input in a power-on state, it is determined whether the disk (media) exists on the tray. The tray moves to the accommodation position in the case where the disk does not exist on the tray. On the other hand, the tray moves to the front end portion adjusting position (standby position) in the case where the disk exists on the tray.

Further, JP-A-H05-212932 discloses a printer (video color printer) which includes a tray for placing a printing sheet thereon. In the printer, when the printing sheet does not exist on the tray after a system initialization, a motor is driven so as to move the tray to the outside of the printer. When the printing sheets are stacked in the tray, the tray is accommodated in the printer. In addition, when a printing process ends, the tray moves to the outside of the printer.

Furthermore, in the printer or the like, a mechanical initialization process is performed upon performing a power-on process, and a mechanical end process is performed upon performing a power-off process. For example, JP-A-2000-99214 discloses a printer which stores a result of a precedent power-off process in an EEPROM and controls an initialization process in accordance with the result of the precedent power-off process upon turning on the printer at the next time. In detail, when the power-off process is not normally performed, an abnormal end (NG) is set to an end flag showing the result of the power-off process. When a cap is empty, an operation of moving a carriage to a home position and an operation of closing the cap are performed. When the operations are normally performed, the end flag is reset (OK). In addition, in the case where the power-off process of the printer is normally performed and the power-on process thereof is performed, when the end flag is reset (OK), the printer becomes a printing activation state by skipping the initialization process.

However, in the mechanical initialization process performed upon turning on the printer, as in JP-A-H05-212932, a reset operation such as a home seek process is performed which moves a moving member such as a carriage in a movement path thereof so as to return the moving member to an original point.

Additionally, in order to decrease the size of the printer, it is necessary to decrease the size of the tray and the accommodation space thereof. In this case, when the disk is placed on the tray and the tray is accommodated in the printer, a problem may arise in that the carriage or printing head interferes with the tray or the disk upon performing the mechanical initialization process such as the home seek process of the carriage due to a part of the disk or tray existing on the movement path of the carriage or the like. In this case, when the power-on operation is performed, the existence of the disk on the tray is detected. In the case where the disk exists on the tray, it is necessary to adopt a configuration in which a user is prompted to extract the disk from the tray by moving the tray to the discharge position (media set position or the like). In this case, when the user performs the power-off operation in the state where the tray having the disk placed thereon is located at the discharge position, it is not possible to control the position of the carriage, the tray, or the like since the mechanical initialization process is not performed, and thus it is not possible to perform the mechanical end process. For this reason, the power supply is interrupted in the state where tray is located at the discharge position.

However, when the tray is located at the discharge position for a long period of time after the power supply is interrupted, a large moment load of the tray is applied to a pair of transport rollers since a base portion of the tray located at the discharge position is supported by being nipped by the pair of transport rollers. In addition, a shaft of the transport roller is bent in a curved shape or a peripheral surface of the transport roller nipping the tray is deformed due to the load of the tray. Further, when the excessive load is continuously applied to the transport roller for a long period of time, particularly, the upper transport driven roller receiving the large load is slightly deformed or bent, which causes a problem that an appropriate transport operation cannot be performed.

SUMMARY

An advantage of some aspects of the invention is that it provides a printing apparatus capable of effectively preventing a deterioration or the like of a tray support part of a tray maintained in a discharged state even when a power-off operation is performed in the state where the tray is maintained in the discharged state before an initialization process required to be performed upon performing a power-on operation ends, and a tray control method of the printing apparatus.

In order to solve the above-described problems, according to an aspect of the invention, there is provided a printing apparatus which includes a tray for setting a printing medium thereon, the printing apparatus including: a switch section which is used to perform a power-on operation or a power-off operation; a tray driving section which performs a driving operation of extracting the tray; a detection section which detects whether the printing medium exists on the tray; a control section which moves the tray to a discharge position by controlling the tray driving section in order to prompt an operation of extracting the printing medium from the tray before an initialization process ends when the printing medium is detected upon performing a power-on process; and a storage section which stores information that the control section moves the tray to the discharge position upon performing the power-on process, wherein the control section determines whether the tray moves to the discharge position upon performing the power-on process on the basis of the information stored in the storage section when the power-off operation is detected before the initialization process ends so as to interrupt a power supply in the state where the tray is located at a current position when the tray does not move to the discharge position upon performing the power-on process or to interrupt the power supply after accommodating the tray in the printing apparatus by controlling the tray driving section when the tray moves to the discharge position upon performing the power-on process.

With the above-described configuration, when the printing medium is detected upon performing the power-on process, the control section moves the tray to the discharge position by controlling the tray driving section in order to prompt an operation of extracting the printing medium from the tray before the initialization process ends (before and during the initialization process). In addition, the control section allows the storage section to store the information that the tray moves to the discharge position. Then, when the control section detects the power-off operation before the initialization process ends, the control section determines whether the tray moves to the discharge position upon performing the power-on process on the basis of the information stored in the storage section. When the tray does not move to the discharge position upon performing the power-on process, the power supply is interrupted in the state where the tray is located at the current position. On the other hand, when the tray moves to the discharge position upon performing the power-on process, the tray driving section is controlled so that the tray is accommodated in the printing apparatus and the power supply is interrupted after accommodating the tray in the printing apparatus. At this time, since the movement path of the tray is guaranteed, it is possible to accommodate the tray in the printing apparatus without any problem upon performing the power-off operation. Accordingly, even when the power-off operation is performed in the discharged state of the tray before the initialization process required to be performed upon performing the power-on operation ends, it is possible to effectively prevent a deterioration or the like of the tray support part caused by the tray maintained in the discharged state.

In the printing apparatus having the above-described configuration, the printing apparatus further includes: a printing section which is adapted to be movable in a direction intersecting a movement path of the tray in order to perform a printing process on the printing medium; and a printing driving section which performs a driving operation of moving the printing section, wherein the detection section may be provided in the printing section, and wherein the control section may perform a home seek process of the printing section among the initialization process by controlling the printing driving section upon performing the power-on process and may perform a detection operation of detecting the existence of the printing medium on the tray using the detection section by moving the printing section after the home seek process so as to accommodate the tray in the printing apparatus by controlling the tray driving section when the printing medium does not exist on the tray as a result of the detection operation using the detection section and to continue the initialization process after accommodating the tray in the printing apparatus.

With the above-described configuration, the position of the printing section is controlled by performing the home seek process of the printing section during the power-on process, and the existence of the printing medium on the tray is detected by the detection section by moving the printing section. When the printing medium is not detected as a result of the detection operation, the tray is accommodated in the printing apparatus and the initialization process is continued after accommodating the tray in the printing apparatus. Accordingly, since the home seek process of the printing section is first performed, it is possible to accurately perform the detection operation, and thus to prevent an error upon performing the detection operation of detecting the existence of the printing medium. Further, when the printing medium does not exist on the tray, the initialization process is continued after accommodating the tray in the printing apparatus. Accordingly, it is possible to efficiently perform the initialization process.

In the printing apparatus having the above-described configuration, the printing apparatus further includes: a manipulation section which is used to extract the tray, wherein whenever the manipulation section is manipulated to accommodate the tray moved to the discharge position in the printing apparatus, the tray may be accommodated in the printing apparatus and the power-on process may be repeated.

With the above-described configuration, after the tray moves to the discharge position so as to prompt the user to extract the printing medium from the tray, the power-on process is repeated whenever the user manipulates the manipulation section so as to accommodate the tray in the printing apparatus. Accordingly, since the information of the tray is stored in the storage section until the user extracts the printing medium from the tray, even when the user manipulates the manipulation section plural times to perform the power-off operation, the tray is pulled into the printing apparatus without any problem due to the stored information that the tray moves to the discharge position upon performing the power-on process.

In the printing apparatus having the above-described configuration, the control section may determine whether the initialization process ends upon performing the power-off process and may pull the tray by controlling the tray driving section if it is determined that the tray moves to the discharge position upon performing the power-on process on the basis of the information stored in the storage section even when the initialization process has not yet ended.

With the above-described configuration, when the initialization process has not yet ended upon performing the power-off process, it is determined whether the tray moves to the discharge position upon performing the power-on process on the basis of the stored information. When the determination is "Yes", the tray is pulled into the printing apparatus. Accordingly, it is possible to accommodate the tray in the printing apparatus without any problem before interrupting the power supply.

In the printing apparatus having the above-described configuration, the control section may interrupt the power supply in the state where the tray is located at the current position if it is determined that the initialization process has not yet ended upon performing the power-off process and the tray does not move to the discharge position upon performing the power-on process on the basis of the information stored in the storage section.

With the above-described configuration, when it is determined that the initialization process has not yet ended upon performing the power-off process and the tray does not move to the discharge position upon performing the power-on process on the basis of the information stored in the storage section, the control section interrupts the power supply in the state where the tray is located at the current position. Accordingly, even in this case, it is possible to interrupt the power supply in the state where the tray is accommodated in the printing apparatus.

In the printing apparatus having the above-described configuration, when the initialization process ends, the control section may perform an end process including an operation of accommodating the tray in the printing apparatus in the case where the tray is located at the discharge position.

With the above-described configuration, when the initialization process ends, the end process including the operation of accommodating the tray in the printing apparatus is performed in the case where the tray is located at the discharge position. Accordingly, even in this case, when the tray is located at the discharge position, the tray is accommodated in the printing apparatus by the end process. Thus, it is possible to interrupt the power supply in the state where the tray is accommodated in the printing apparatus.

According to another aspect of the invention, there is provided a tray control method of a printing apparatus which includes a tray for setting a printing medium thereon, the tray control method including: a detection step of detecting whether the printing medium exists on the tray upon performing a power-on process; a tray moving step of moving the tray to a discharge position in order to prompt an operation of extracting the printing medium from the tray before an initialization process ends when the printing medium exists on the tray as a result of the detection step; a storage step of storing information that the tray moves to the discharge position upon performing a power-on process; a first determination step of determining whether the initialization process ends when a power-off operation is detected; a second determination step of determining whether the tray moves to the discharge position upon performing the power-on process on the basis of the information stored in the storage section if the initialization process has not yet ended; and a power supply interrupting step of interrupting a power supply in the state where the tray is located at a current position when the tray does not move to the discharge position upon performing the power-on process or interrupts the power supply after accommodating the tray in the printing apparatus when the tray moves to the discharge position upon performing the power-on process. With the above-described configuration, it is possible to obtain the same advantage as that of the printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of an ink jet multi-functional printer as one of various types of printing apparatuses will be described with reference to FIGS. 1 to 12.

Figure 1:
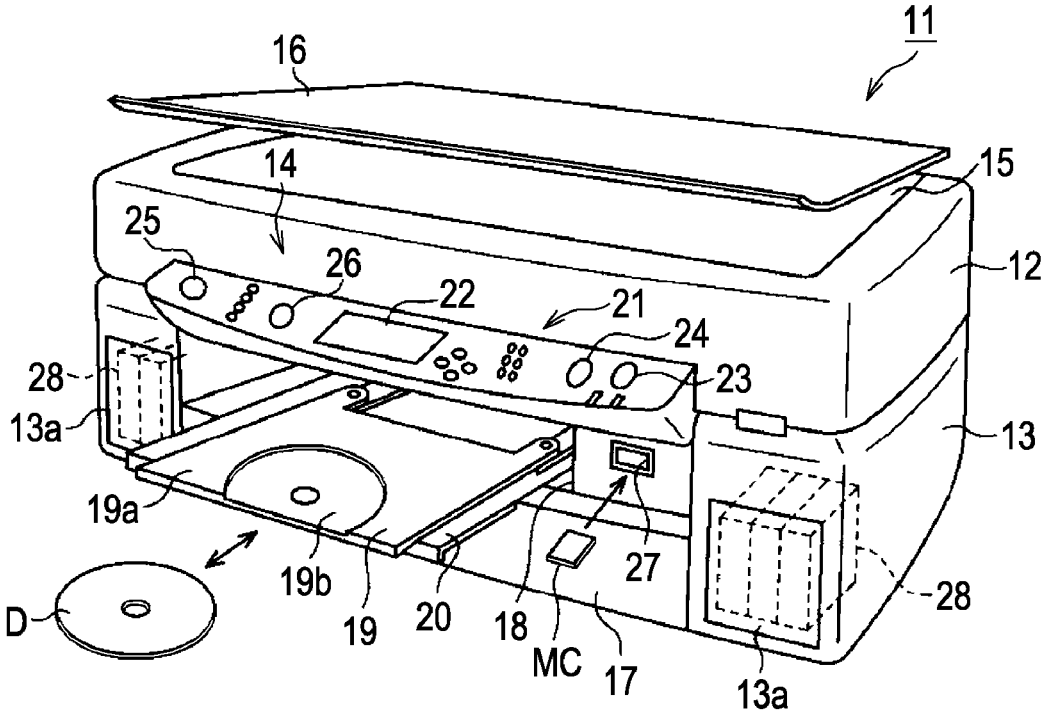
FIG. 1 is a perspective view showing a multi-functional printer according to an embodiment.

As shown in FIG. 1, one unit of the ink jet multi-functional printer (hereinafter, simply referred to as "a printer 11") corresponds to a color printer having three functions of a scanner, a printer, and a copier. The printer 11 includes a scanner unit 12 which reads an image of a document and inputs the image as image data, a printer unit 13 which prints an image based on print data on a predetermined printing medium (media), and a manipulation panel 14. The copy function is realized in such a manner that the image data read by the scanner unit 12 is converted into the print data by the printer unit 13 and the image based on the print data is printed by the printer unit 13.

The scanner unit 12 is disposed on the upper side of the printer unit 13, and the upper portion of the scanner unit 12 is provided with a document table glass 15 on which a document is placed and a document table cover 16 which covers the document table glass 15. The document table cover 16 is provided in the scanner unit 12 so as to be openable or closeable.

A paper sheet feeding cassette 17 which accommodates a paper sheet P (printing medium) to be fed to the printer unit 13 is inserted into the lower portion of the printer 11 so as to be detachable therefrom. The upper portion of the paper sheet feeding cassette 17 is provided with a discharge portion 18 which discharges the paper sheet P printed by the printer unit 13. In the printer 11 according to the embodiment, in order to perform a printing process on a label surface of an optical disk (hereinafter, simply referred to as "a disk D") such as a CD-R or a DVD-R, a disk holding tray (hereinafter, simply referred to as "a tray 19") which places (sets) the disk D thereon is provided in an opening of the discharge portion 18 so as to be drawn out therefrom. A substantially square-plate-shaped tray body 19*a* of the tray 19 is provided with a substantially annular set concave portion 19*b* which sets the disk D thereon. In addition, FIG. 1 shows the state where the tray 19 is located at a set position (discharge position) in which the disk D is set on or extracted from the tray 19, and a three-stage telescopic paper sheet discharging stacker 20 is provided below the tray 19 so as to place the paper sheet, discharged to the discharge portion 18, thereon.

The manipulation panel 14 located at a position adjacent to the substantially upper end of the front surface of the printer 11 includes a manipulation portion 21 which is manipulated by a user and a display portion 22 which performs various displays thereon. The display portion 22 is formed by, for example, a color liquid crystal display. The display portion 22 displays a menu screen, a text showing operation states and setting states for various modes, or an image used to select a print object image or to check the print image on the screen.

The manipulation portion 21 is provided with manipulation buttons enables the user to perform various manipulations. For example, as the manipulation buttons, a selection button for selecting various menus, a mode selection button, and the like are provided in addition to a power switch 23 (power button) for turning on or off a power source, a print start button 24 for starting a printing process, a copy button 25 for starting a copy process, a tray open-close switch 26 for drawing out the tray 19, and the like. For example, a label print is performed in such a manner that a label print mode is selected by the mode selection button, a required setting item (a CD size, an image selection, and the like) is selected on the setting screen, and the print start button 24 is pushed.

In addition, a card slot 27 is provided on the right side of the front surface of the printer 11. For example, when a memory card MC storing therein an image captured by a digital camera or the like is inserted into the card slot 27, it is possible to print the image stored in the memory card MC without using a host device such as a personal computer. Further, the printer 11 includes a USB port (not shown) used to be connected to a terminal of a USB cable. Accordingly, it is possible to perform a printing process by directly reading the image data from the digital camera via the USB cable. Also, it is possible to perform the printing process on the basis of the image data received from a printer driver of the host device via the USB cable. Furthermore, plural ink cartridges 28 are provided in the lower portions on the left and right sides of the front part of the printer 11 so as to be covered by a cover 13*a* and to be accommodated in a cartridge holder (not shown) in a connected state.

Figure 2:
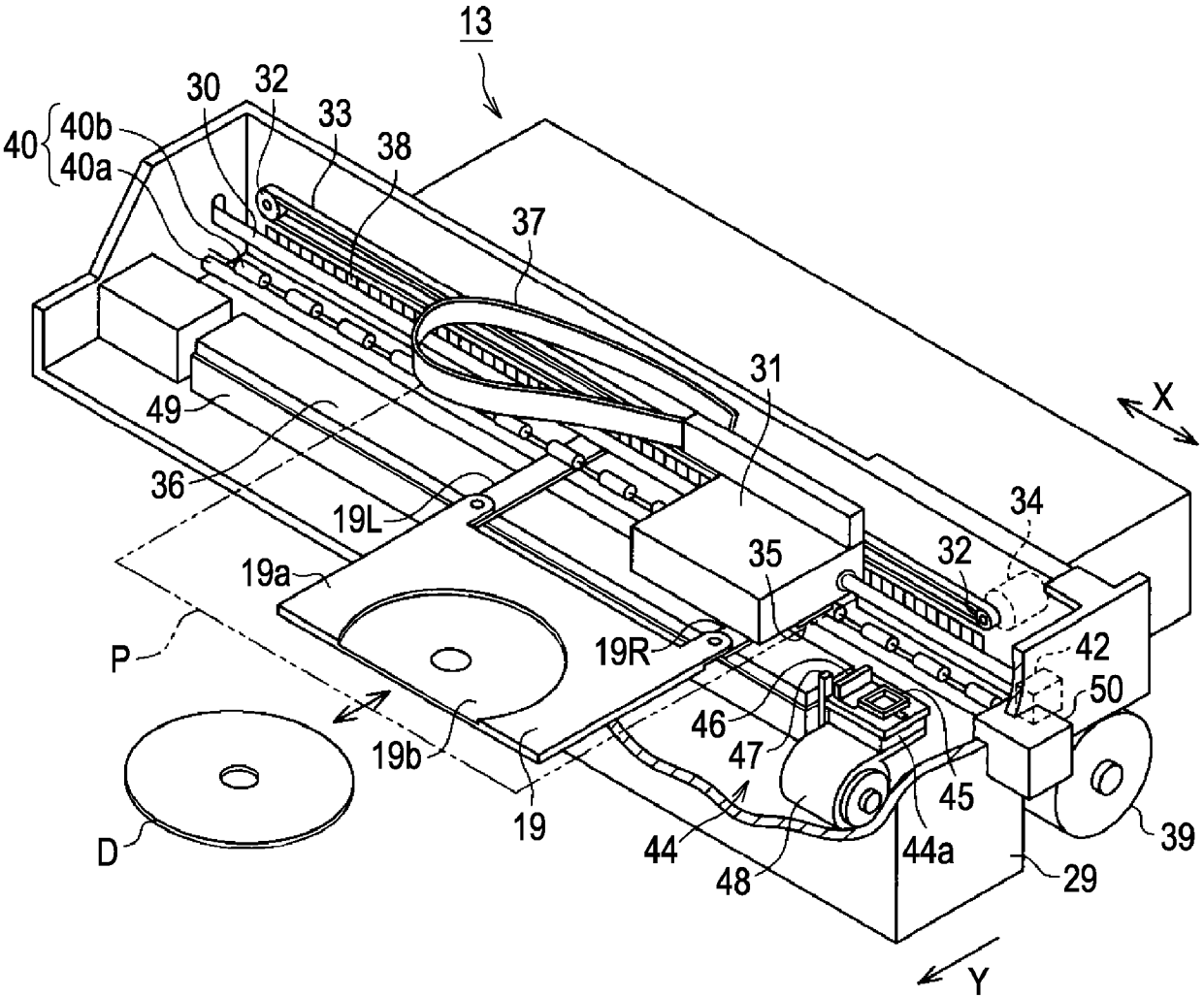
FIG. 2 is a perspective view showing a printer unit.

Next, the configuration of the printer unit will be described. FIG. 2 is a perspective view showing the printer unit.

As shown in FIG. 2, the printer unit 13 includes a substantially square-box-shaped body frame 29 of which the upper and lower portions thereof are opened. In the same drawing, a guide shaft 30 having a predetermined length is provided between left and right side walls of the body frame 29, and a carriage 31 is adapted to be movable in a reciprocating manner along the guide shaft 30 in a main scanning direction X. The carriage 31 is fixed to an endless-shaped timing belt 33 which is wound on a pair of pulleys 32 attached to the inner surface of the rear plate of the body frame 29. When the timing belt 33 rotates in a normal direction or a reverse direction in accordance with a normal or reverse rotation of a carriage motor (hereinafter, referred to as "a CR motor 34") attached to a driving shaft of the pulley 32 located on the right side in FIG. 2, the carriage 31 moves in a reciprocating manner in the main scanning direction X.

An ink jet printing head 35 is provided in the lower portion of the carriage 31, and the lower surface of the printing head 35 is formed as a nozzle formation surface 35*a* (see FIG. 3) where plural rows of nozzles are opened so as to eject liquid as ink.

In the body frame 29, a platen 36 is provided at a position facing the printing head 35 so as to regulate a gap between the printing head 35 and the paper sheet. In addition, the printing head 35 is connected to the plural ink cartridges 28 via a flexible piping plate 37 in which plural ink supply tubes for ink colors are provided in a collected state. For example, each ink of four colors of black (K), cyan (C), magenta (M), and yellow (Y) is individually supplied from each ink cartridge 28 to the printing head 35. In addition, the flexible piping plate 37 includes an electric wiring for driving the printing head 35. Further, the rear surface of the carriage 31 is provided with a linear encoder 38 which outputs the number of pulses in proportional to the movement amount of the carriage 31, where the linear encoder 38 extends along the guide shaft 30.

In FIG. 2, the lower portion on the right side of the body frame 29 is provided with a paper sheet feeding motor (hereinafter, referred to as "a PF motor 39"). When the PF motor 39 is driven, a pair of transport rollers 40 and a pair of discharge rollers 41 (see FIG. 3) respectively disposed on the upstream side and the downstream side in a transport direction with the platen 36 interposed therebetween are rotationally driven to thereby transport the paper sheet P of the tray 19 in a sub-scanning direction Y At this time, when the PF motor 39 is driven in the normal or reverse direction in the state where the tray body 19*a* or a pair of guide arms 19L and 19R is nipped by the pair of transport rollers 40, the tray 19 is drawn out in the sub-scanning direction (transport direction). In addition, upon performing the printing process on the paper sheet P, the tray 19 recedes to an accommodation position on the upstream side of the pair of transport rollers 40 in the transport direction so as not to interfere with a paper sheet transport path to be described later. Further, the pair of transport rollers 40 includes a transport driving roller 40*a* which is rotationally driven by power of the PF motor 39 and a driven roller 40*b* which is rotated by coming into contact with the transport driving roller 40*a*.

When the printing process and the transporting process are alternately performed by reciprocating the carriage 31 in the sub-scanning direction X, the image or text is printed on the paper sheet P or the disk D, where the printing process is a process in which ink is ejected from the nozzle of the printing head 35 onto the label surface of the paper sheet P or the disk D, and the transporting process is a process in which the paper sheet P or the disk D is transported by a predetermined transport amount in the sub-scanning direction Y.

Further, the printer 11 includes an automatic platen gap adjusting device (hereinafter, referred to as "an APG device 42") which moves the carriage 31 in the vertical direction so as to adjust a gap between the printing head 35 and the platen 36 (platen gap). On the basis of information on the type of the paper sheet obtained from the host device or the setting information of the manipulation panel 14, the APG device 42 is driven so as to ensure the appropriate platen gap in accordance with the type of the paper sheet, so that the carriage 31 is adjusted to be located at a height capable of ensuring a predetermined paper gap (a gap between the printing head 35 and the paper sheet). In addition, during the label printing process, the APG device 42 is driven so as to ensure a wide platen gap in accordance with a thickness of the disk D, so that the carriage 31 is located at, for example, a maximum ascending position. Further, in the embodiment, the APG device 42 constitutes a gap adjusting section.

In FIG. 2, a right end position of a movement path of the carriage 31 is set to a home position where the carriage 31 is located when the printing process is not performed. A capping device 44 (maintenance unit) is disposed right below the carriage 31 located at the home position so as to perform a maintenance process such as a nozzle cleaning on the printing head 35.

The capping device 44 includes a cap 45 which is a cover member for preventing ink inside the nozzle of the printing head 35 from drying up, a wiper 46 which cleans the nozzle formation surface 35*a*, a lock member 47 which locks the carriage 31 so as to be located at the home position, an elevation mechanism 44*a* which elevates the respective members 45, 46, and 47, and a suction pump 48. By means of the elevation mechanism 44*a*, the respective members 45, 46, and 47 elevate between an ascending position and a receding position (maximum descending position) where the printing head 35 is not interfered. At the ascending position, the cap 45 comes into contact with the nozzle formation surface 35*a* of the printing head 35 so as to surround the nozzle, and the wiper 46 is located at a position capable of cleaning the nozzle formation 35*a*. Also, the lock member 47 engages with a locking concave portion (not shown) of the carriage 31 so that the carriage 31 is locked to the home position.

In addition to the function (capping function) of the cover member for preventing the nozzle opening from being dried, the cap 45 functions as a part of a liquid suction mechanism for compulsorily sucking ink from the nozzle and discharging the ink to the outside in such a manner that the cap 45 caps the nozzle formation surface 35*a* of the printing head 35 and a negative pressure generated by the suction pump 48 is applied to a space inside the cap. The suction pump 48 includes, for example, a tube pump, where waste ink sucked from the nozzle and discharged to the inside of the cap 45 is discharged to a waste water tank 49 disposed on the lower side of the platen 36.

In addition, a power transmission switching device 50 is provided in the vicinity of the home position of the carriage 31. When the carriage 31 is located at a switching position in the vicinity of the home position, a connection state of the power transmission switching device 50 is switched to a disconnection state, and a connection position (switching position) is selected in accordance with the rotation of the transport driving roller 40*a*. When the carriage 31 recedes from the switching position, a connection position selecting a power transmission path of the PF motor 39 is selected. In the embodiment, the PF motor 39 is used as the common power source for the APG device 42, the capping device 44, an automatic feeding device (hereinafter, simply referred to as "a feeding device 52") (see FIG. 3), and an elevation device (see FIGS. 9A, 9B, and 9C) of a medium discharging frame (hereinafter, referred to as "an EJ frame 125"). In addition, when the switching operation of the power transmission switching device 50 is performed, one of the power transmission paths of the devices 42, 44, 52, and the like is selected. Further, the power transmission path from the PF motor 39 to the pair of transport rollers 40 and the pair of discharge rollers 41 is always in a connection state irrespective of the switching position of the power transmission switching device 50.

Figure 3:
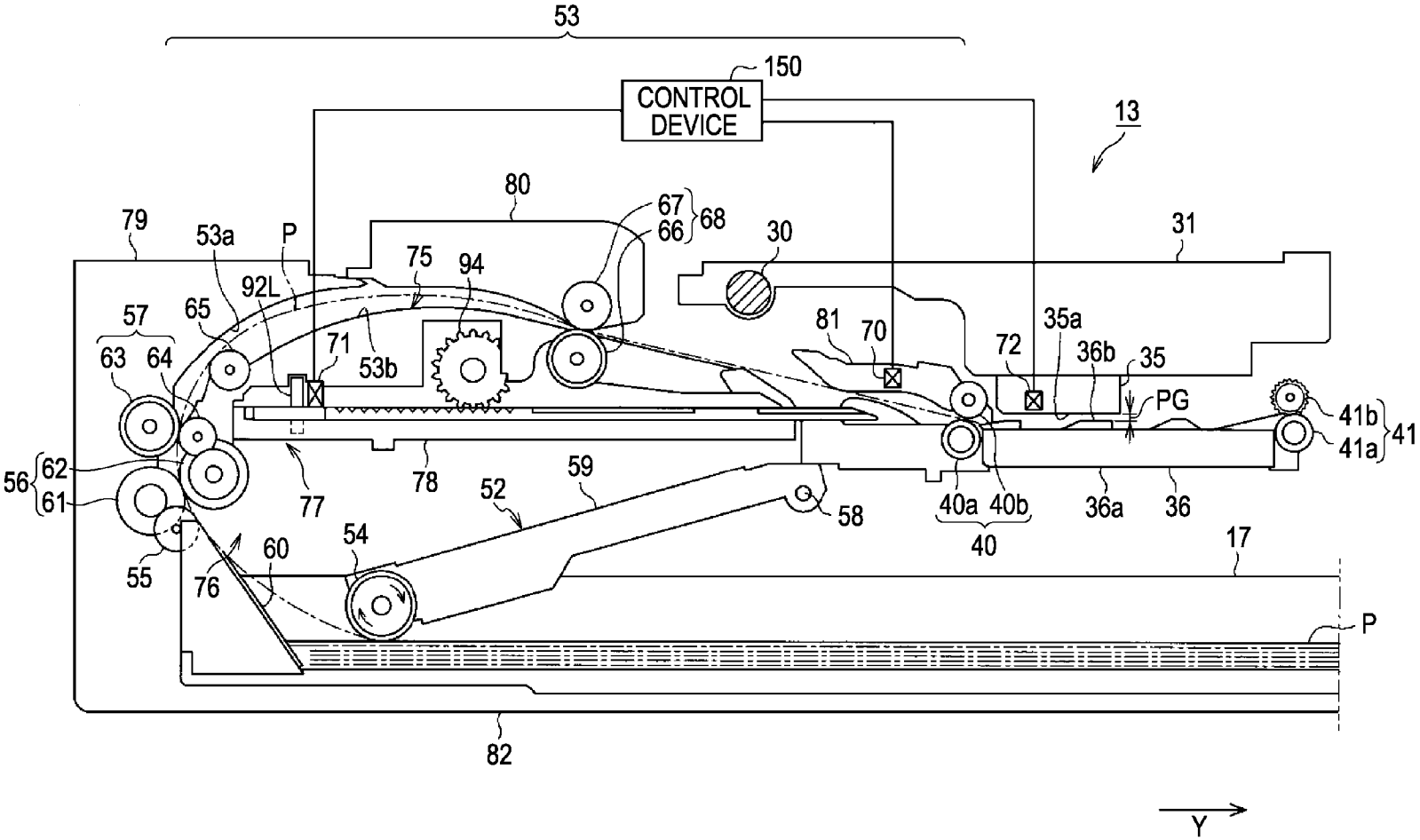
FIG. 3 is a side view showing the printer unit.

Next, the detailed configuration of the printer unit 13 will be described. FIG. 3 is a schematic side cross-sectional view showing an inner structure of the printer in the state where the tray is located at the accommodation position. The paper sheet feeding cassette 17 is detachably attached to the lower portion of the center portion of the front surface 13*b* of the printer unit 13 so as to accommodate plural sheets of paper sheets P in a piled state. The paper sheets P accommodated in the paper sheet feeding cassette 17 are sequentially sent out one by one from the uppermost paper sheet P by a feeing device 52 so as to be fed to a U-shaped curved inverse path 53 to be described later.

The feeding device 52 includes the paper sheet feeding cassette 17, a pickup roller 54, a guide roller 55, a separator 56, and a first intermediate transport roller 57. The paper sheet feeding cassette 17 is capable of setting plural sheets of paper sheets P in a piled state, and the accommodated paper sheets P are positioned to a feeding position by an edge guide (not shown).

The pickup roller 54 is provided in a swinging member 59 which swings about a swing shaft 58. When the pickup roller 54 rotates using the PF motor 39 (see FIG. 2) as a power source by coming into contact with the uppermost paper sheet P set in the paper sheet feeding cassette 17, the uppermost paper sheet P is sent out from the paper sheet feeding cassette 17.

When the front end portion of the paper sheet P sent out by the rotation of the pickup roller 54 moves to the downstream side while coming into contact with a separation slope surface 60, the paper sheet P sent out from the paper sheet feeding cassette 17 is preliminarily separated from the next paper sheet P. The rotatable guide roller 55 is provided on the downstream side of the separation slope surface 60, and a separation member 56 including a separation roller 61 and a driving roller 62 is provided on the downstream side of the guide roller 55. In the separation roller 61, the outer peripheral surface formed of an elastic material comes into pressing contact with the driving roller 62, and is applied with a predetermined rotation resistance by using a torque limiter mechanism. Accordingly, the next paper sheet P stops between the separation roller 61 and the driving roller 62, thereby preventing a sheet overlapping feeding phenomenon.

A first intermediate transport roller 57 is provided on the downstream side of the separation member 56, and includes a driving roller 63 and an assist roller 64 rotated in a following manner by nipping the paper sheet P between itself and the driving roller 63. The paper sheet P is sent further to the downstream side by the first intermediate transport roller 57. In addition, a driven roller 65 is provided on the downstream side of the first intermediate transport roller 57 so as to reduce a load generated when the paper sheet P passes through the curved inverse path 53.

Further, a second intermediate transport roller 68 is provided on the downstream side of the feeding device 52 (driven roller 65), and includes a driving roller 66 and an assist roller 67 rotated in a following manner by nipping the paper sheet P between itself and the driving roller 66. The paper sheet P is sent further to the downstream side by the second intermediate transport roller 68. In addition, in the embodiment, the pickup roller 54, the guide roller 55, the separation member 56, the first intermediate transport roller 57, the second intermediate transport roller 68, and the like constitute a transport mechanism.

The pair of transport rollers 40, the printing head 35, the platen 36, and the pair of discharge rollers 41 are provided on the downstream side of the second intermediate transport roller 68. In addition, a position detector 70 (paper sheet detecting sensor) as a detection mechanism is provided in the vicinity of the upstream side of the pair of transport rollers 40 so as to detect the paper sheet P or the tray 19. The position detector 70 detects the passage state of the front end portion of the fed paper sheet P or the rear end portion of the transported paper sheet P, and detects the passage state of a reference position (original point) of the tray 19 when the tray 19 moves. In the embodiment, the position detector 70 includes, for example, an optical sensor. Of course, the position detector 70 may be formed as a contact-type sensor.

In the state where paper sheet P is nipped between the transport driving roller 40*a* and the driven roller 40*b*, the feeding operation of the paper sheet P is continued (the position of the front end portion of the paper sheet P is adjusted) until the front end portion of the paper sheet P arrives at a print start position, and then the paper sheet P is precisely transported to the downstream side during the feeding operation of the paper sheet P after starting the printing process.

In the state where the carriage 31 is guided along the guide shaft 30 extending in the main scanning direction (a direction perpendicular to FIG. 3), the carriage 31 is driven by the CR motor 34 (FIG. 2) so as to reciprocate in the main scanning direction. In addition, the carriage 31 is of a so-called off carriage type in which the ink cartridge is not loaded. Ink is supplied from the ink cartridges 28 (FIG. 1) to the printing head 35 via an ink supply tube (not shown) of the flexible piping plate 37.

The platen 36 is provided at a position facing the printing head 35, and a gap PG between the paper sheet P and the printing head 35 is regulated by the platen 36. In addition, in the embodiment, the gap PG is changed to four stages by the APG device 42 (shown in FIG. 8).

The pair of discharge rollers 41 provided on the downstream side of the platen 36 in the transport direction includes the driving roller 41*a* and the driven roller 41*b* rotated in a following manner by coming into contact with the driving roller 41*a*. The paper sheet P having been subjected to the printing process of the printing head 35 is discharged to the paper sheet discharging stacker 20 (see FIG. 1) provided on the front side of the printer by the pair of discharge rollers 41. In addition, the pickup roller 54, the driving roller 62, the driving roller 63, and the driving roller 66 constituting the feeding device 52 are rotationally driven by the power of the PF motor 39.

The printer 11 includes a tray accommodation detector 71 and a paper sheet width sensor 72 in addition to the position detector 70. Among the sensor and detectors, the tray accommodation detector 71 is a contact-type mechanical detector, and detects whether the tray 19 is located at the accommodation position shown in FIG. 3. In detail, the tray accommodation detector 71 is disposed on the upstream side of the tray 19 located at the accommodation position in the transport direction during the printing process. The tray accommodation detector 71 detects the tray 19 in such a manner that a detection contact member (not shown) comes into contact with the tray 19.

In addition, the paper sheet width sensor 72 is an optical sensor, and is provided in the carriage 31 so as to be located at a position adjacent to the printing head 35. When the carriage 31 moves in the main scanning direction X, the paper sheet width sensor 72 emits light and receives reflected light of the emitted light. Then, the end portion or the existence of the disk D placed on the tray 19 and the paper sheet P is detected by the paper sheet width sensor 72 in consideration of a degree of reflectivity. The position detector 70, the tray accommodation detector 71, and the paper sheet width sensor 72 are respectively configured to transmit signals for informing the detection states to a control device 150. In addition, in some cases, the home position in the movement direction (main scanning direction X) of the carriage 31 is referred to as "one digit side", and the opposite home position is referred to as "eighty digit side".

As shown in FIG. 3, the size of the tray 19 accommodated in an inner space 76 of a path forming member 75 forming the curved inverse path 53 is short. In order to move the tray 19 to the set position, an extending movement mechanism 77 which extends a movement stroke is connected to the rear end portion of the tray body 19*a*. In addition, a support member 78 for supporting the rear surface (lower surface) of the tray 19 is incorporated into the path forming member 75.

The curved inverse path 53 is provided by means of the rear space of the printer unit 13. The curved inverse path 53 includes upper housings 79 and 80 which form an outer guide surface 53*a*, a transport guide 81, a lower housing 82 located below the upper housings 79 and 80, and the path forming member 75 forming an inner guide surface 53*b*.

Figure 4:
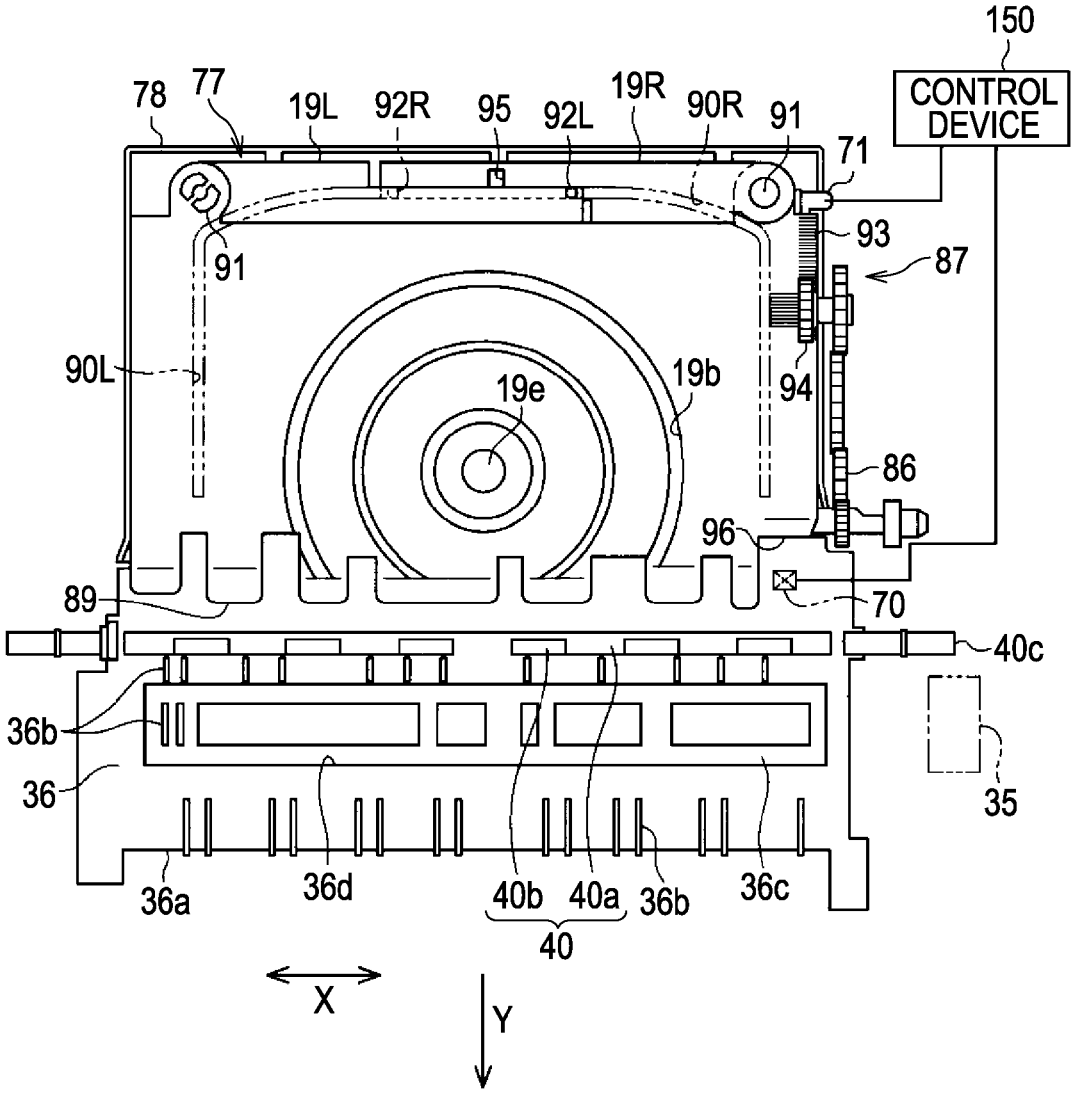
FIG. 4 is a plane view showing the vicinity of a tray located at an accommodation position.

FIG. 4 is a plane view showing the vicinity of the tray 19 located at the accommodation position. As shown in FIG. 4, at a position adjacent to a slight front position (lower position in FIG. 4) of the central position of the width direction (transverse direction in FIG. 4) of the upper surface of the tray body 19*a* of the tray 19, there are provided a set concave portion 19*b* which sets the disk D thereon and a holding convex portion 19*e* which holds the set disk D in a center hole thereof. In addition, an example of the disk D which can be set on the tray 19 includes a blue-ray disk which gains attention as a next generation optical disk, a CD-R, a CD-RW, a DVD-R, or a DVD-RW having a diameter of 12 cm or 8 cm in addition to various optical disks to be developed later.

As shown in FIG. 4, the front end portion of the tray 19 is provided with a slope guide claw 89 formed in a comb shape in which the front portion of the guide claw 89 is low. When the tray 19 advances from the accommodation position, the guide claw 89 is smoothly inserted between the pair of transport rollers 40. In addition, the extension movement mechanism 77 connected to the rear end portion of the tray 19 includes foldable guide arms 19L and 19R which are rotatably connected to the tray 19 and guide rails 90L and 90R which guide the posture and movement of the guide arms 19L and 19R. The guide arms 19L and 19R are respectively formed as elongate flat members having a narrow width, and the base end portions thereof are rotatably connected to the left and right end portions of the rear edge of the tray body 19*a* via a rotary shaft 91, respectively.

Further, the front end portions of the guide arms 19L and 19R are respectively provided with a guide pin 92L which protrudes upward from the left guide arm 19L and a guide pin 92R which protrudes downward from the right guide arm 19R. In addition, the guide pin 92L engages with an L-shaped guide rail 90L which is provided in the inner peripheral surface of the path forming member 75, and the guide pin 92R engages with a bilaterally symmetric L-shaped guide rail 90R which is provided in the upper surface of the support member 78.

A detection target hole 95 (set position hole) is formed at a position adjacent to the front end portion of the right guide arm 19R. In addition, the right end of the front edge of the tray body 19*a* is provided with a notch portion 96. The detection target hole 95 and the notch portion 96 correspond to a detection target of the position detector 70. When the tray 19 moves, the position detector 70 is separated from the notch portion 96 and detects the tray body 19*a*. Then, a position at the time when the detection signal is changed from an off state to an on state is set to the reference position of the tray 19. In addition, a position at the time when the position detector 70 detects the detection target hole 95 is set to the set position of the tray 19.

The power of the PF motor 39 (FIG. 2) is transmitted to a roller driving shaft 40*c* shown in FIG. 4, and is transmitted to an auxiliary transport mechanism 87 via a gear wheel row 86. The auxiliary transport mechanism 87 is formed by a rack and pinion mechanism, and includes a rack 93 which is provided in the rear portion of the right edge of the upper surface of the tray body 19*a* and a pinion 94 which is provided in the terminal end portion of the gear wheel row 86 for transmitting the power of the roller driving shaft 40*c*.

The movement of the tray 19 in the transport direction Y and the opposite transport direction −Y is performed by the auxiliary transport mechanism 87 and the pair of transport rollers 40. The auxiliary transport mechanism 87 performs the movement of the tray 19 between the accommodation position and the printing standby position (FIG. 5C) and the movement of the tray 19 between the printing standby position and the accommodation position. In addition, the movement of the tray 19 between the printing standby position (FIG. 5C) and the set position (FIGS. 1, 2, and 5A) is performed by the rotation of the pair of transport rollers 40 nipping the tray 19.

That is, when the power of the roller driving shaft 40*c* is transmitted to the rack 93 of the tray 19 located at the accommodation position in FIG. 4 via the gear wheel row 86 and the pinion 94, the tray 19 starts to move forward. When the guide claw 89 of the front end portion of the tray 19 arrives at the nip point of the pair of transport rollers 40, the power transmission from the auxiliary transport mechanism 87 ends, and the tray 19 arrives at the printing standby position (FIG. 5C) where the power of the pair of transport rollers 40 is transmitted to the tray 19. In addition, since the printing process is performed on the label surface of the disk D in the case of using the tray 19, the APG device 42 is operated in advance so as to set the gap PG for the disk D by enlarging the gap between the printing head 35 and the platen 36.

Further, as shown in FIG. 4, the platen 36 includes a transport guide portion 36*a* which is a support member, a platen rib 36*b* which is formed in the upper surface of the transport guide portion 36*a*, and an ink collecting groove 36*d* which is exposed in an absorbing member 36*c* for absorbing excessive ink which is not used in the printing process (all of them are shown in FIG. 4).

Figure 5A:
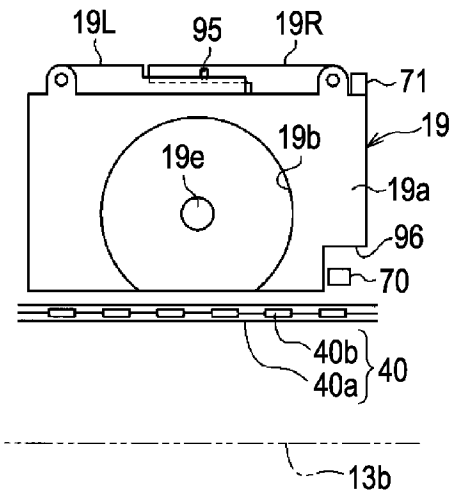
FIGS. 5A, 5B, and 5C are schematic plane views illustrating an operation of the tray.
Figure 5B:
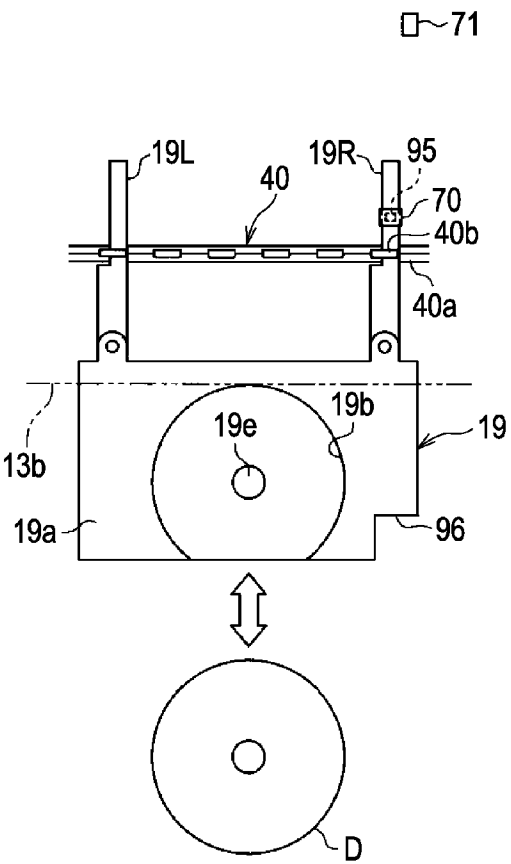
Figure 5C:
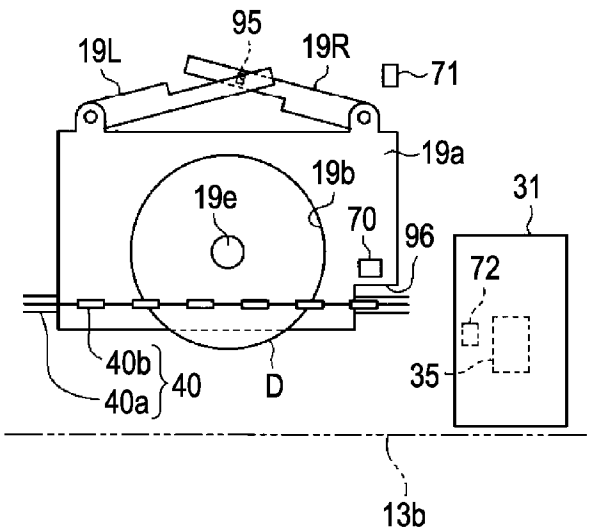

FIG. 5 is a schematic plane view showing the movement operation of the tray. FIG. 5A shows the accommodation position, FIG. 5B shows the set position, and FIG. 5C shows the printing standby position. As shown in FIG. 5A, in the case where the tray 19 is located at the accommodation position, the tray 19 moves to the upstream side of the pair of transport rollers 40. In the case where the tray 19 is located at the accommodation position, it is possible to perform the printing process on the paper sheet P since the pair of transport rollers 40 does not interfere with the transported paper sheet P and the tray 19.

In the case where the tray 19 is located at the accommodation position, the tray accommodation detector 71 becomes an on state since the tray accommodation detector 71 comes into contact with the tray 19. The position detector 70 becomes an off state since the position detector 70 faces the notch portion 96 (see FIG. 4) of the tray 19. In addition, the paper sheet width sensor 72 becomes an off state since there is nothing on the platen 36. Further, when the tray 19 moves to the accommodation position, the movement of the tray 19 is permitted after the existence of the disk D on the tray 19 is checked by the paper sheet width sensor 72. Accordingly, the disk D does not exist on the tray 19 located at the accommodation position.

In the printing standby position shown in FIG. 5C, the tray accommodation detector 71 becomes an off state since the tray accommodation detector 71 is away from the tray 19. In addition, the position detector 70 becomes an on state since the position detector 70 faces the tray 19. Further, the paper sheet width sensor 72 becomes an on state since the paper sheet width sensor 72 faces the disk D having high reflectivity.

In the case where the disk D is set on the tray 19 or the disk D having been subjected to the printing process is drawn out from the tray 19, the tray 19 is located at the set position shown in FIG. 5B so that the tray 19 is fully drawn out to the front side of the printer. When the tray 19 is located at the set position, the left and right guide arms 19L and 19R are nipped by the pair of transport rollers 40. In addition, in the entire movement path of the tray 19, the guide pins 92L and 92R respectively engage with the guide rails 90L and 90R, and the posture of the guide arms 19L and 19R continuously changed from the folded state shown in FIGS. 4 and 5A to the extended state shown in FIG. 5B.

In the case where the tray 19 is located at the set position shown in FIG. 5B, the tray accommodation detector 71 becomes an off state since the tray accommodation detector 71 is away from the tray 19. The position detector 70 becomes an off state since the position detector 70 faces the detection target hole 95 of the right guide arm 19R. The paper sheet width sensor 72 becomes an off state since the paper sheet width sensor 72 faces the tray 19 having low reflectivity. In addition, when the tray 19 first moves from the accommodation position to the set position in a power-on state, the detection target of the position detector 70 is changed from the notch portion 96 to the tray 19. Accordingly, the position of the tray 19 at the time when the position detector 70 is changed from on off state to an on state is set to the reference position, and the position of the tray 19 is recognized as a position (count value) relative to the reference position.

Power Transmission Switching Device

Figure 6:
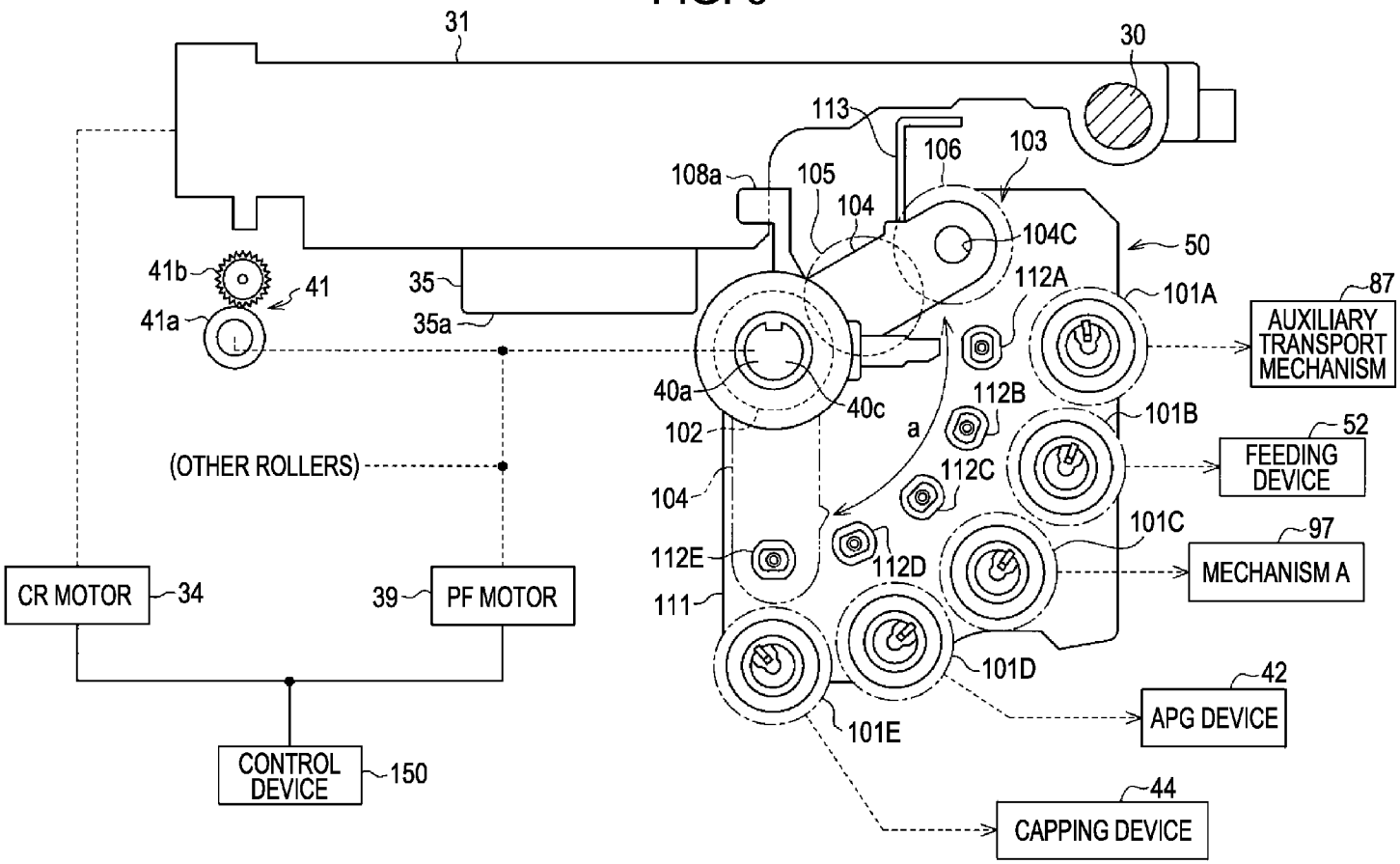
FIG. 6 is a schematic side view showing a power transmission switching device.

Next, the configuration of the power transmission switching device 50 will be described. First, the schematic configuration of the power transmission switching device 50 will be described with reference to FIG. 6. As shown in FIG. 6, the printer 11 includes the PF motor 39 and the CR motor 34 as the power source, and the two motors are controlled by the control device 150. The PF motor 39 is used as the common power source for the driving rollers 40*a*, 41*a*, 54, 62, 63, and 66, and changes the power transmission position via the power transmission switching device 50 so as to drive various driven parts of the printer 11, requiring the power, such as the feeding device 52, the APG device 42, the capping device 44, the auxiliary transport mechanism 87, and the mechanism A 97 in printer 11. Here, the driving rollers 40*a*, 41*a*, 54, 62, 63, and 66 provided in the paper sheet transport path are connected one-to-one to the PF motor 39 without using the power transmission switching device 50, and are rotated when the PF motor 39 is rotationally driven. In addition, the mechanism A 97 in FIG. 6 shows, for example, a driven portion of an ink supply pump which supplies ink of the ink cartridges 28 to the printing head 35 in a pressurized state. The ink supply pump is provided inside the cartridge holder connected to the ink cartridges 28 or is provided in the course of the ink supply passageway between the cartridge holder and the printing head 35. In the embodiment, the number of power transmission positions of the power transmission switching device 50 is five, but may be, for example, six or more if the number is plural.

As shown in FIG. 6, the driving gear 102 is attached to the roller driving shaft 40*c* of the transport driving roller 40*a* so as to be rotatable together. The power transmission switching device 50 includes a power transmission portion 103 which is rotated to select one of input gears 101A, 101B, 101C, 101D, and 101E upon receiving rotary torque from the driving gear 102 of the transport driving roller 40*a* used as the power shaft (power input shaft) and which transmits the rotary torque to the one selected input gear. The input gears 101A, 101B, 101C, 101D, and 101E show the input gears of the auxiliary transport mechanism 87, the feeding device 52, the mechanism A 97, the APG device 42, and the capping device 44. As shown in FIG. 6, the five input gears 101A, 101B, 101C, 101D, and 101E are respectively arranged at positions equally away from the transport driving roller 40*a*, and are arranged in a row at the same interval therebetween so as to form a circular-arc shape in a plane perpendicular to the axis of the transport driving roller 40*a*.

The power transmission portion 103 includes an arm member 104 which is rotatably attached to the end portion of the roller driving shaft 40*c*, a first planetary gear 105 which is rotatably supported to the arm member 104 at a position meshing with the driving gear 102, and a second planetary gear 106 which is rotatably supported to the first planetary gear 105 so as to mesh therewith. The arm member 104 is relatively rotatable about the roller driving shaft 40*c* as a rotary shaft, and is attached to the roller driving shaft 40*c* so as to be movable in a thrust direction of the roller driving shaft 40*c*. When the carriage 31 moving in a forward direction of FIG. 6 pushes a carriage engagement portion 108*a* in the forward direction of FIG. 6, the power transmission portion 103 moves from a first position to a second position along the roller driving shaft 40*c* in the thrust direction. Then, the meshed state between the second planetary gear 106 and the input gear 101A, 101B, 101C, 101D, or 101E is released, and the power transmission portion 103 engages with the roller driving shaft 40*c* so as to be rotatable together. In addition, when the roller driving shaft 40*c* rotates by a predetermined rotation amount, the arm member 104 rotates to thereby select one input gear capable of meshing with the second planetary gear 106. Subsequently, when the carriage 31 recedes in a backward direction of FIG. 6, the power transmission portion 103 returns to the first position by urging force, and the second planetary gear 106 meshes with one selected input gear. For example, when rotary torque is transmitted in the state where the second planetary gear 106 meshes with the input gear 101A, the auxiliary transport mechanism 87 is driven.

Figure 7:
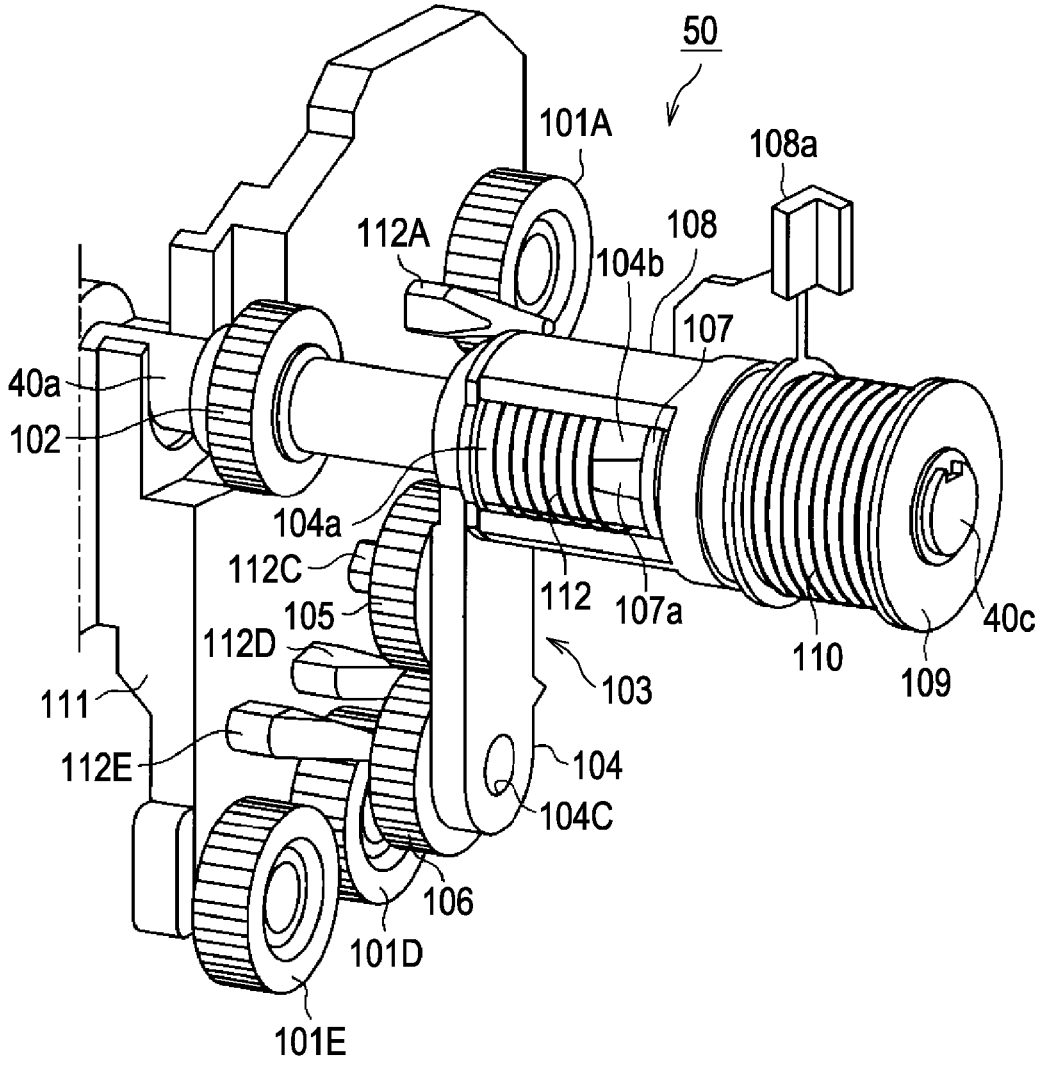
FIG. 7 is a perspective view showing the power transmission switching device.

Next, the detailed configuration of the power transmission switching device 50 will be described with reference to FIGS. 6 and 7. FIG. 7 is a perspective view showing the power transmission switching device 50. In addition, FIG. 7 shows the state where the power transmission portion 103 is located at the second position in which the meshed state between the input gear and the power transmission portion 103 is released. The power transmission portion 103 shown in FIGS. 6 and 7 is provided so as to be displaceable between the first and second positions which are located in the axial direction of the roller driving shaft 40*c*.

The arm member 104 includes a sleeve portion 104*a* having a shaft hole for allowing the roller driving shaft 40*c* to be inserted therethrough. The arm member 104 is slidable in the axial direction of the roller driving shaft 40*c* via the sleeve portion 104*a*, and is swingable about the roller driving shaft 40*c* as a swing shaft in a direction depicted by the arrow a shown in FIG. 6. As shown in FIG. 7, the end portion of the sleeve portion 104*a* of the arm member 104 is provided with a first engagement gear portion 104*b* having plural protrusion teeth protruding in the thrust direction and arranged in a circumferential direction.

Further, as shown in FIG. 7, a cylindrical member 107 is fixed to a position facing the first engagement gear portion 104*b* so as to rotate together with the roller driving shaft 40*c*. A second engagement gear portion 107*a* having plural protrusion teeth capable of meshing with the first engagement gear portion 104*b* is provided in the cylindrical member 107 so as to be located at a position facing the first engagement gear portion 104*b*.

As shown in FIG. 7, a cylindrical casing member 108 is provided so as to accommodate the first engagement gear portion 104*b* and the second engagement gear portion 107*a* therein. The sleeve portion 104*a* is allowed to be inserted into the casing member 108 via the opening provided on one side of the casing member 108. In the casing member 108, the roller driving shaft 40*c* and the arm member 104 are rotatable relative to the casing member 108. Even when the arm member 104 rotates, the casing member 108 maintains the posture in which the carriage engagement portion 108*a* protrudes upward.

As shown in FIG. 7, the shaft end portion of the roller driving shaft 40*c* is provided with a stopper 109. By means of urging force of a first coil spring 110 interposed between the stopper 109 and the casing member 108, the arm member 104 is urged in a direction toward a frame member 111 (the left direction of FIG. 7). Since the arm member 104 comes into contact with a regulation portion (not shown) of the frame member 111 due to the urging force, the first position is maintained.

Further, a second coil spring 112 is provided between the first engagement gear portion 104*b* and the left inner end surface of the casing member 108 shown in FIG. 7. When the carriage 31 pushes the carriage engagement portion 108*a* in the right direction of FIG. 7 so that the casing member 108 displaces in the right direction of FIG. 7 against the urging force of the first coil spring 110, the first engagement gear portion 104*b* is pushed in the right direction of FIG. 7 via the second coil spring 112, and the arm member 104 displaces in the right direction. As a result, the meshed state between the input gear and the second planetary gear 106 supported to the swing front end of the arm member 104 is released. Then, when the power transmission portion 103 moves to the second position, as shown in FIG. 7, the first engagement gear portion 104*b* meshes with the second engagement gear portion 107*a*.

At this time, even when both engagement gear portions 104*b* and 107*a* do not normally mesh with each other, but the front end portions of both gears collides with each other, elastic force of the second coil spring 112 is used as a cushion, thereby preventing occurrence of breakage or the like. In addition, when the transport driving roller 40*a* rotates by a predetermined amount in the state where the front end portions of both gears collide with each other, as shown in FIG. 7, both engagement gear portions 104*b* and 107*a* normally mesh with each other. Further, when the PF motor 39 is rotationally driven by a predetermined rotation amount in a predetermined direction in the state where the power transmission portion 103 is located at the second position so that both engagement gear portions 104*b* and 107*a* mesh with each other as shown in FIG. 7, the arm member 104 rotates together with the roller driving shaft 40*c* so as to select to the next connection position where the second planetary gear 106 is capable of meshing with one of the input gears 101A, 101B, 101C, 101D, and 101E.

In addition, when the carriage 31 moves away from the carriage engagement portion 108*a* in the second position shown in FIG. 7, the power transmission portion 103 moves to the first position by the urging force of the first coil spring 110. Also, the meshed state between the first engagement gear portion 104*b* and the second engagement gear portion 107*a* is released, and the second planetary gear 106 meshes with one selected input gear.

Further, in the frame member 111, positioning pins 112A, 112B, 112C, 112D, and 112E are respectively provided in the vicinity of positions corresponding to the input gears 101A, 101B, 101C, 101D, and 101E so as to protrude therefrom in the vertical direction. For example, when the positioning pin 112E is inserted into the hole 104C provided in the front end portion of the arm member 104 in the state where the second planetary gear 106 provided in the arm member 104 meshes with the input gear 101E, the swinging action of the arm member 104 is restrained, and the meshed state between the second planetary gear 106 and the input gear 101E is maintained.

Likewise, in the state where the power transmission portion 103 is located at the first position, the first planetary gear 105 meshes with the driving gear 102, and the rotary torque is transmitted in a sequential order of the driving gear 102, the first planetary gear 105, the second planetary gear 106, and one input gear selected from the input gears 101A, 101B, 101C, 101D, and 101E to thereby drive at least one of driven parts. In addition, as shown in FIG. 6, a positioning frame 113 is provided so as to come into contact with the arm member 104 when the arm member 104 rotates to the end in the counter-clockwise direction in FIG. 6. The rotation position of the arm member 104 is managed on the basis of an original point corresponding to the position where the arm member 104 comes into contact with the positioning frame 113.

Further, the power transmission portion 103 may be disposed between the first position and the second position. An intermediate position is set between the first position and the second position of the power transmission portion 103. In addition, by means of a holding member (not shown), the power transmission portion 103 is capable of being located at the intermediate position against the urging force of the first coil spring 110 irrespective of the position of the carriage 31.

APG Device

Figure 8:
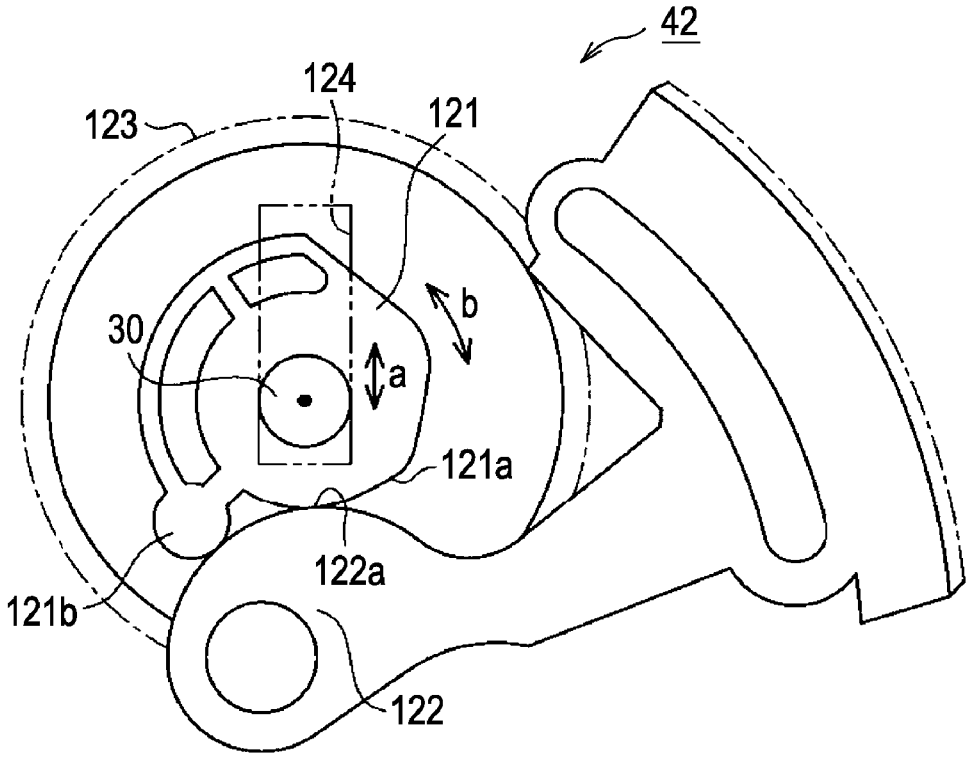
FIG. 8 is a side view showing an APG device.

Next, the configuration of the APG device 42 will be described. FIG. 8 is a side view showing the APG device. The APG device 42 is a device which adjusts the gap PG between the printing head 35 and the platen 36. As shown in FIG. 8, the APG device 42 includes a PG switching cam 121 which is attached to the axial end of the guide shaft 30 for the carriage, a regulation member 122 which engages with the PG switching cam 121, and a gear 123 which is attached to the axial end of the guide shaft 30.

In the PG switching cam 121, a peripheral cam surface 121*a* is formed such that a distance from the axis of the guide shaft 30 is different in the circumferential direction. The cam surface 121*a* is supported by a regulation surface 122*a* of the regulation member 122.

The axial end of the guide shaft 30 is loosely inserted into an elongate groove 124 which extends in a PG adjusting direction (the vertical direction of FIG. 8: the direction depicted by the arrow a). When the guide shaft 30 rotates, the PG switching cam 121 rotates relative to the regulation member 122 (in the direction depicted by the arrow b in the same drawing) so that the guide shaft 30 displaces in the PG adjusting direction. In addition, the gear 123 is a gear which obtains power from the input gear 101D of the power transmission switching device 50.

The APG device 42 with such a configuration is configured to stepwisely change the gap PG in four stages in a sequential order of a small gap to a large gap. Here, the PG switching cam 121 is provided with a stopper portion 121*b*. When the stopper portion 121*b* comes into contact with the regulation member 122, the rotation of the PG switching cam 121 stops.

Accordingly, upon changing the gap PG, the PG switching cam 121 first rotates in the counter-clockwise direction of FIG. 8 until the rotation of the PG switching cam 121 stops due to an action of the stopper portion 121*b* coming into contact with the regulation member 122. Then, when the PG switching cam 121 rotates by a predetermined rotation amount in the clockwise direction of FIG. 8 in this state (a state where a driving current value of the PF motor 39 exceeds a threshold value), the desired gap PG is set.

Figure 9A:
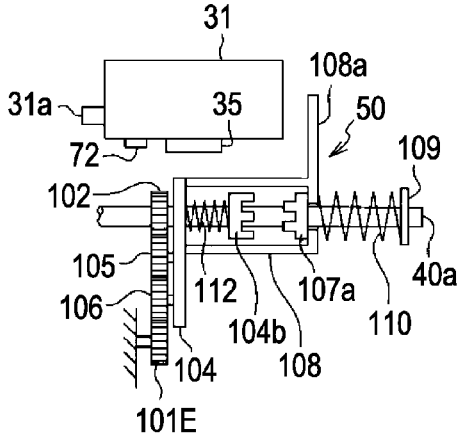
FIGS. 9A, 9B, and 9C are schematic front views illustrating operations of an APG reset process and an EJ frame reset process.
Figure 9B:
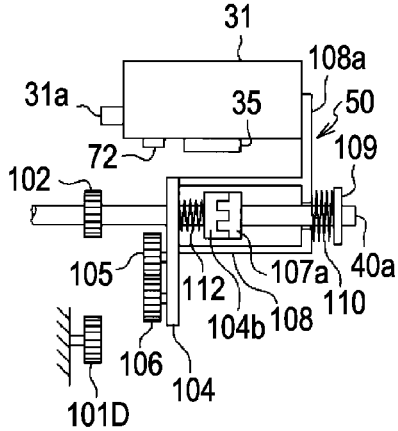
Figure 9C:
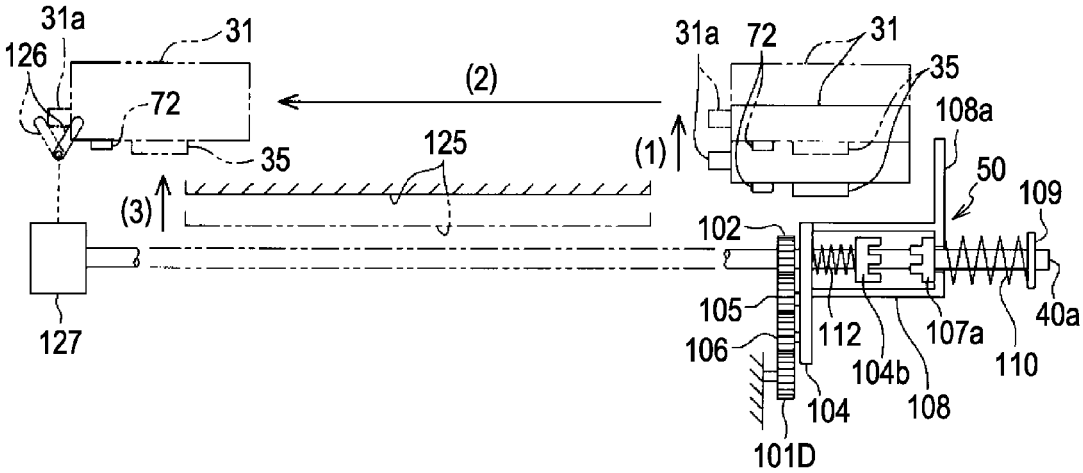

Next, the operation of the initialization process will be described with reference to FIGS. 9A, 9B, and 9C. In the initial process of a power-on process, there are initial items such as a carriage home position seek process (hereinafter, referred to as "a CR home seek process"), a PF reset operation, an APG reset operation, a paper sheet discharge frame reset operation (EJ frame reset operation), and a capping operation. FIGS. 9A, 9B, and 9C are schematic front view illustrating the APG reset operation and the paper sheet discharge frame reset operation corresponding to the initial items, where the operations cause the switching operation of the power transmission switching device 50.

When the carriage 31 located at the home position shown in FIG. 9A moves away from the carriage engagement portion 108*a* so that the arm member 104 is located at the first position, the second planetary gear 106 meshes with, for example, the input gear 101E. At this time, the first engagement gear portion 104*b* does not mesh with the second engagement gear portion 107*a*.

When the carriage 31 moves further from the home position to the switching selection position shown in FIG. 9B on the one digit side, the carriage 31 pushes the carriage engagement portion 108*a* so that the arm member 104 moves to the second position. As a result, the meshed state between the second planetary gear 106 and the input gear 101E is released, and the first engagement gear portion 104*b* meshes with the second engagement gear portion 107*a*. Then, when the PF metro 39 is rotationally driven in this state so that the transport driving roller 40*a* rotates, the arm member 104 rotates by meshing both engagement gear portions 104*b* and 107*a* with each other so as to select the next connection position where the second planetary gear 106 is capable of meshing with the input gear 101D of the APG device 42. Then, when the carriage 31 moves from the switching selection position to the home position, as shown in FIG. 9C, the second planetary gear 106 meshes with the input gear 101D of the APG device 42.

When the PF motor 39 is rotationally driven in this state, the rotary torque of the transport driving roller 40*a* is transmitted to the input gear 101D via the power transmission switching device 50. Then, when the PG switching cam 121 of the APG device 42 rotates so that the guide shaft 30 maximally ascends along the elongate groove 124, the carriage 31 is located at the maximum ascending position where the gap PG is a maximum value, and the APG device 42 is reset.

Likewise, after the carriage 31 is located at the maximum ascending position depicted by the two-dot dashed line in FIG. 9C, when the carriage 31 slightly moves to the one digit side by driving the CR motor 34 in the reverse direction, the carriage engagement portion 108*a* is pushed by a half degree. Accordingly, the arm member 104 is located at the intermediate position, and the power transmission from the APG device 42 is interrupted. Next, when the CR motor 34 is driven in the normal direction, the carriage 31 moves to the opposite home position. A lever 126 is provided at the opposite home position so as to be manipulated by an engagement portion 31*a* protruding from the side surface of the carriage 31, and the lever 126 is rotationally manipulated by the carriage 31 moving to the opposite home position. In the embodiment, an elevatable EJ frame 125 is provided in the vicinity of a discharge opening of the printer unit 13. When the printing process is performed on the paper sheet P, the EJ frame 125 descends so that a height-direction gap of the discharge opening is equal to a narrow gap in accordance with the thickness of the paper sheet P. On the other hand, when the printing process is performed on the label, the EJ frame 125 ascends so that the height-direction gap of the discharge opening is equal to a wide gap in accordance with the thickness of the disk D. When the lever 126 is located at a position depicted by the solid line in FIG. 9C, an elevation mechanism 127 of the EJ frame 125 is disconnected from the transport driving roller 40*a* so as to disable the power transmission therebetween. When the lever 126 is located at a position depicted by the two-dot dashed line in FIG. 9C, the elevation mechanism 127 is connected to the transport driving roller 40*a* so as to enable the power transmission therebetween. For this reason, when the PF motor 39 is rotationally driven in the state where the lever 126 is manipulated by the carriage 31 to be located at a position depicted by the two-dot dashed line, the EJ frame 125 moves from the descending position depicted by the two-dot dashed line in FIG. 5C to the maximum ascending position depicted by the solid line. Then, when the EJ frame 125 arrives at the maximum ascending position depicted by the solid line in FIG. 5C, the EJ frame 125 is reset.

Further, in the reset operation, in addition to the reset operation at the original point position, a reciprocation operation is performed so as to check whether the movement in the entire movement path is possible. For example, after the EJ frame 125 is reset to the original point, the EJ frame 125 reciprocates between the maximum ascending position and the maximum descending position so as to check whether an alien material corresponding to an obstacle of the movement exists in the course of the movement path. In addition, after the APG device 42 is reset to the original point, the carriage 31 reciprocates between the maximum ascending position and the maximum descending position so as to check whether an alien material corresponding to an obstacle of the movement exists in the course of the movement path.

In addition, the PF reset operation is a process performed to guarantee that an alien material (for example, a jammed paper sheet or the like) corresponding to an obstacle of the transport does not exist in the transport path. In the PF reset operation, an operation is performed which rotationally drive the pair of transport rollers 40 by a predetermined rotation amount in the paper sheet discharge direction in order to remove the paper sheet existing on the transport path from the transport path even when the paper sheet exists in the transport path, and a process is performed which checks the non-detected state (where the paper sheet, the tray, or the like does not exist on the transport path) of the position detector 70. In addition, the other initialization items such as the home seek process will be described later. Further, the electric process of the APG reset operation and the PF reset operation will be described later.

Figure 10:
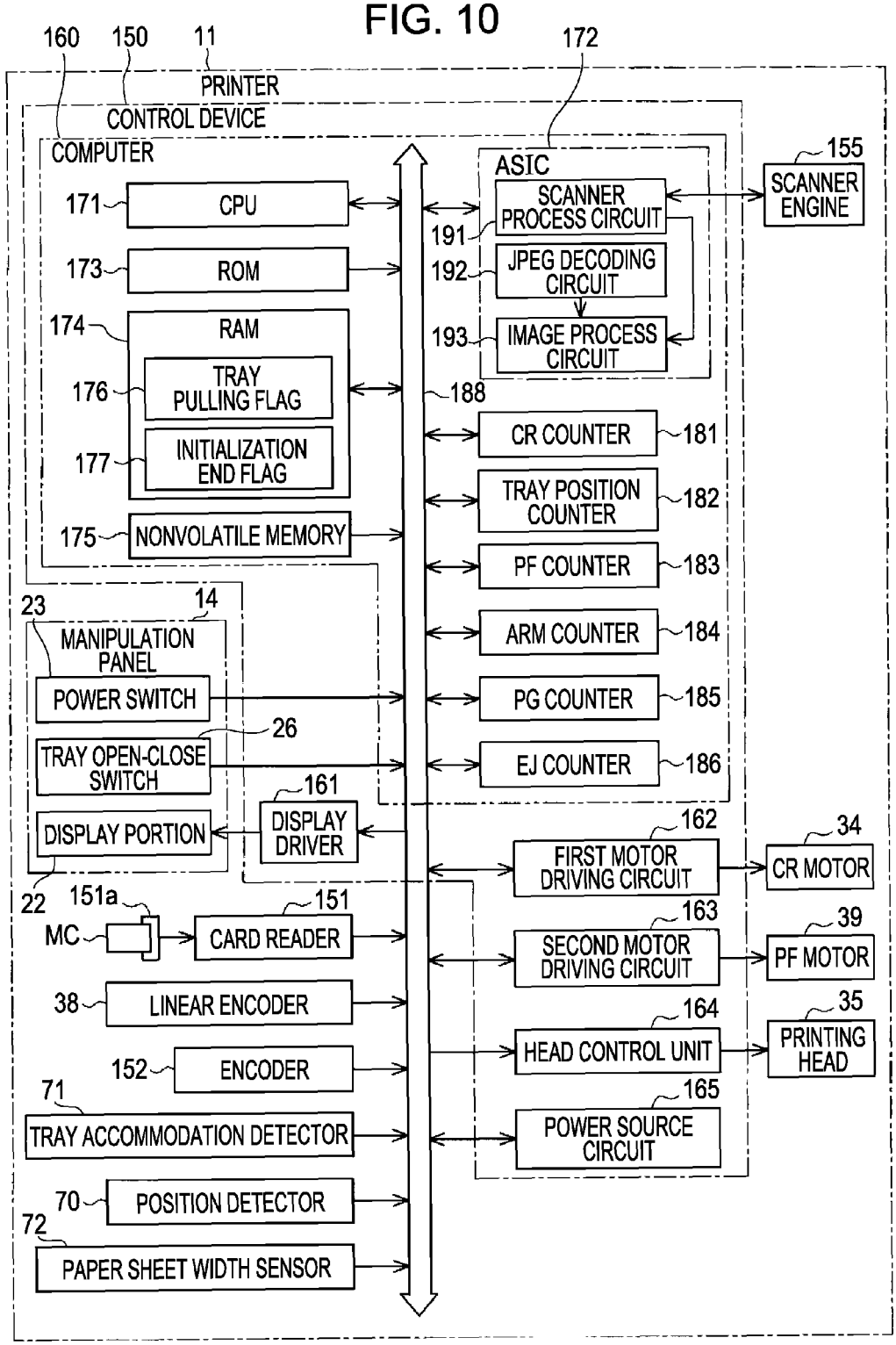
FIG. 10 is a block diagram showing an electric configuration of the printer.

Next, the electric configuration of the printer 11 will be described. FIG. 10 is a block diagram showing the electric configuration of the printer 11. As shown in FIG. 10, the printer 11 includes the control device 150. The control device 150 generally controls the printer 11.

The control device 150 is connected to an input system, that is, various switches including the power switch 23 constituting the manipulation panel 14, the display portion 22, a card reader 151, the linear encoder 38, an encoder 152, the tray accommodation detector 71, the position detector 70, and the paper sheet width sensor 72. In addition, the control device 150 is connected to an output system, that is, a scanner engine 155, the CR motor 34, the PF motor 39, and the printing head 35.

The control device 150 includes a computer 160 (micro computer), a display driver 161, a first motor driving circuit 162, a second motor driving circuit 163, a head control unit 164, and a power source circuit 165. The computer 160 performs a display control of the display portion 22 by using the display driver 161. In addition, the computer 160 controls the driving operation of the CR motor 34 by using the first motor driving circuit 162, and controls the driving operation of the PF motor 39 by using the second motor driving circuit 163. Further, the computer 160 controls the driving operation of the printing head 35 by using the head control unit 164 so as to perform an ejection control of an ink droplet. In addition, the computer 160 turns on or off the printer 11 by controlling the power source circuit 165 on the basis of the push signal of the power switch 23.

Further, the computer 160 includes a CPU 171, an ASIC (Application Specific IC) 172, a ROM 173, a RAM 174, a nonvolatile memory 175, a CR counter 181, a tray position counter 182, a PF counter 183, an arm counter 184, a PG counter 185, and an EJ counter 186, which are connected to each other via a bus 188. The ASIC 172 includes a scanner process circuit 191, a JPEG decoding circuit 192, and an image process circuit 193.

The ROM 173 stores a control program and the like which are executed by the CPU 171. The RAM 174 temporarily stores various data or the like used to execute a control program or a calculation result of the CPU 171 for the purpose of the process thereof. In addition, a part of the RAM 174 is used as a buffer which temporarily stores print data or image data before and after the process of the image process circuit 193 and the scanner process circuit 191 provided in the ASIC 172 or the CPU 171. In the RAM 174 according to the embodiment, a tray pulling flag 176 and an initialization end flag 177 are set.

The scanner engine 155 optically reads the document placed on the document table glass 15, and outputs an electric charge accumulated in a CCD (charge coupled device) to the scanner process circuit 191 after performing an A/D conversion process on the electric charge using an A/D converting circuit. In the scanner process circuit 191, respective raster line data (multi-grayscale image data of RGB) input from the scanner engine 155 is accumulated in the buffer under the control of the CPU 171, and the RGB image data is sent to the image process circuit 193.

The JPEG decoding circuit 192 decompresses the image data of a JPEG format into, for example, multi-grayscale image data of RGB. For example, image data of a JPEG format captured by a digital camera is read from the memory card MC by the card reader 151 via an input terminal 151*a*, and is transmitted to the JPEG decoding circuit 192 provided in the ASIC 172. The JPEG decoding circuit 192 performs a decoding process on the image data of the JPEG format so that the image data is decoded into, for example, multi-grayscale image data of RGB, and the image data is transmitted to the image process circuit 193.

The image process circuit 193 performs a known image process such as a color change process, a halftone process, and a micro weave process on, for example, the image data of the RGB format transmitted from the scanner process circuit 191 or the JPEG decoding circuit 192, and transmits the image data having been subjected to the known image process to the RAM (buffer) 174. The CPU 171 creates head driving data (print data) on the basis of the image data stored in the buffer, and transmits the created head driving data to the head control unit 164. The head control unit 164 drives the printing head 35 on the basis of the head driving data, and controls the ejection of the ink droplet or the amount of the ejected ink droplet.

The linear encoder 38 includes a code plate of a black semitransparent tape shape which is provided along the movement path of the carriage 31 and in which a predetermined slit is provided in the longitudinal direction, and an optical sensor which is fixed to a predetermined position of the carriage 31 so as to detect the slit of the code plate (the code plate and the optical sensor are not shown). The optical sensor includes a pair of light emitting and receiving elements facing each other with the code plate interposed therebetween, and the light receiving element receives light emitted from the light emitting element and passing through the slit of the code plate. Accordingly, the linear encoder 38 outputs a pulse having the number of pulses proportional to the movement distance of the carriage 31 and a cycle inverse-proportional to the movement speed of the carriage 31. In the home seek process of the carriage 31, when the carriage 31 moves to the one digit side and comes into contact with the end of the one digit side so that a driving current value of the CR motor 34 exceeds a predetermined threshold value, the CPU 171 resets the CR counter 181 and counts the number of pulses input from the linear encoder 38. In addition, the value of the CR counter 181 increases when the carriage 31 moves to the eighty digit side, and the value of the CR counter 181 decreases when the carriage 31 moves to the one digit side. The CPU 171 is configured to detect the position of the carriage 31 in the main scanning direction X on the basis of the count value of the CR counter 181.

In addition, the encoder 152 includes a rotary code disk which is fixed to the end portion of the shaft portion (for example, the shaft portion of the transport driving roller 40*a*) connected to the PF motor 39 so as to enable the power transmission therebetween, and a sensor which outputs two pulse signals having a phase difference of 90° therebetween in such a manner that a light receiving element receives light emitted from a light emitting element and passing through a predetermined slit formed in the code disk in the circumferential direction.

The tray position counter 182 is reset when the position detector 70 detects the front end portion corresponding to the notch portion 96 (see FIG. 4) of the tray 19. After the tray position counter 182 is reset, the tray counter 182 counts the number of pulse edges of the pulse signal input from the encoder 152. In addition, the value of the tray position counter 182 increases when the tray 19 moves to the downstream side in the transport direction, and the value of the tray position counter 182 decreases when the tray 19 moves to the upstream side in the transport direction. Accordingly, the CPU 171 is configured to detect the position of the tray 19 in the transport direction Y on the basis of the count value of the tray position counter 182.

The PF counter 183 is reset when the position detector 70 detects the front end portion of the paper sheet P, and is reset again when the front end portion of the paper sheet P arrives at the most upstream nozzle position (reference position) of the printing head 35. After the PF counter 183 is reset again, the PF counter 183 counts the number of pulse edges of the pulse signal input from the encoder 152. Accordingly, the CPU 171 is configured to detect the transport position of the paper sheet P, of which the reference position is set to the original point, on the basis of the count value of the PF counter 183.

The arm counter 184 is reset when the arm member 104 of the power transmission switching device 50 rotates in the counter-clockwise direction of FIG. 6 so as to come into contact with the positioning frame 113 and a driving current value of the PF motor 39 exceeds a predetermined threshold value. After the arm counter 184 is reset, the arm counter 184 counts the number of pulse edges of the pulse signal input from the encoder 152. Accordingly, the CPU 171 is configured to detect the position of the arm member 104 on the basis of the count value of the arm counter 184.

The PG counter 185 is reset when the carriage 31 arrives at the end of the maximum ascending position and the driving current value of the PF motor 39 exceeds the predetermined threshold value. After the PG counter 185 is reset, the PG counter 185 increases or decreases the number of pulse edges of the pulse signal input from the encoder 152 in accordance with the movement direction of the carriage 31. Accordingly, the CPU 171 is configured to detect the height-direction position (i.e., the gap PG) of the carriage 31 on the basis of the count value of the PG counter 185.

The EJ counter 186 is reset when the EJ frame 125 arrives at the end of the maximum ascending position and the driving current value of the PF motor 39 exceeds the predetermined threshold value. After the EJ counter 186 is reset, the EJ counter 186 increases or decreases the number of pulse edges of the pulse signal input from the encoder 152 in accordance with the movement direction of the EJ frame 125. Accordingly, the CPU 171 is configured to detect the height-direction position (i.e., the discharge opening width) of the EJ frame 125 on the basis of the count value of the EJ counter 186.

Here, the tray pulling flag 176 is a flag for determining whether the tray 19 located at the set position is pulled or not upon tuning off the printer 11. In the embodiment, the existence of the disk on the tray 19 is detected when the printer 11 is turned on by pushing the power switch 23 in the stop state of the printer 11. In the case where the disk exists on the tray 19, the tray 19 moves to the set position, and the user is prompted to extract the disk D from the tray 19. This is because the carriage 31, the printing head 35, the EJ frame 125, or the like may interfere with the disk D. If the disk D exists on the tray 19, the mechanical initialization process cannot be performed. However, in some cases, the user may turn off the printer 11 in the state where the tray 19 is located at the set position. In this case, since the mechanical initialization process has not yet ended, when the printer 11 is turned off in the state where the mechanical end process is not performed, the tray 19 is located at the set position. In the case where the tray 19 moves to the set position by detecting the disk D upon turning on the printer 11, the mechanical initialization process is not performed. In this state, when the printer 11 is turned off, the movement path of the tray 19 is guaranteed due to the fact that the tray 19 moves to the set position. The tray pulling flag 176 is used to store the fact that the movement path of the tray 19 is guaranteed. For this reason, the tray pulling flag 176 is set when the tray 19 moves to the set position by detecting the disk D upon turning on the printer 11. The tray pulling flag 176 is reset upon turning on the printer 11 or pulling the set tray 19. Alternatively, the tray pulling flag 176 is reset after pulling the set tray 19. In the embodiment, the tray pulling flag set/reset operation is described in the mechanical initialization routine (FIG. 11) to be described later.

In addition, the initialization end flag 177 is a flag for storing information determining whether the mechanical initialization process ends. In the case where the mechanical initialization process does not end, the initialization end flag 177 is reset. In the case where the mechanical initialization process ends, the initialization end flag 177 is set.

The movement path of the tray 19 is guaranteed during the time when the tray pulling flag 176 is set before the mechanical initialization process ends. However, after the disk D is extracted from the tray 19 and the mechanical initialization process starts, the height of the carriage 31, the height of the EJ frame 125, or the like may change due to the initialization process. For this reason, the movement path of the tray 19 cannot be guaranteed.

Figure 11:
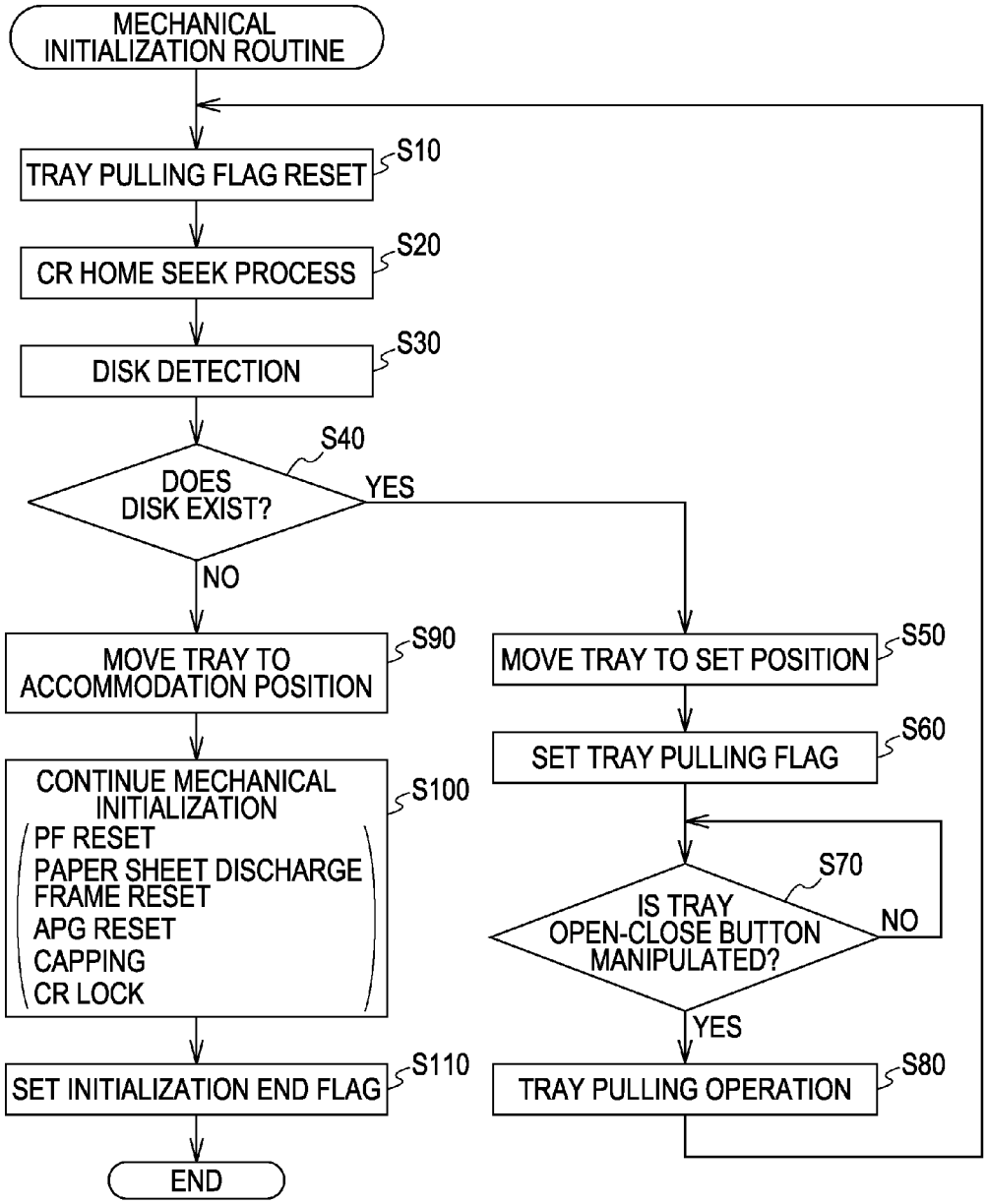
FIG. 11 is a flowchart showing a mechanical initialization routine upon turning on the printer.
Figure 12:
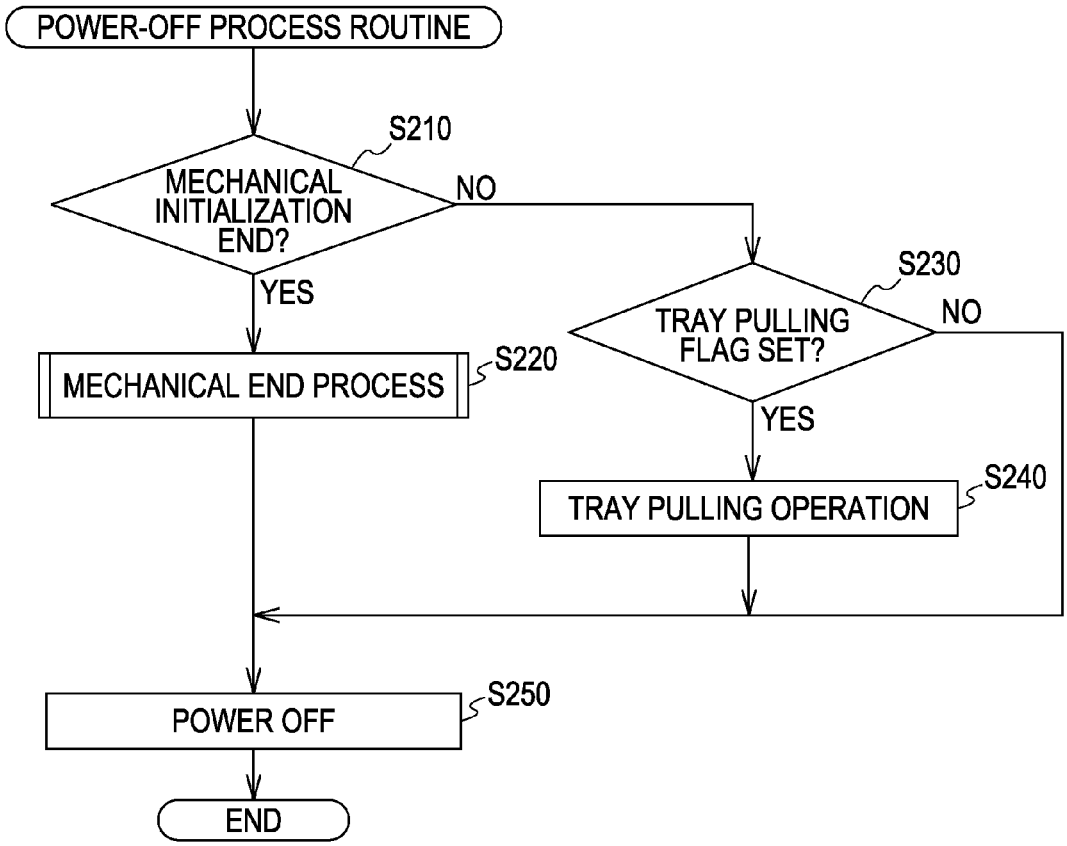
FIG. 12 is a flowchart showing a power-off process routine.

The nonvolatile memory 175 stores a program for the mechanical initialization routine shown in the flowchart in FIG. 11 and a program for the power-off process routine shown in the flowchart in FIG. 12. When the CPU 171 detects that the power switch 23 is pushed (i.e., the power-on operation is performed) in the stop state (a power-off state) of the printer 11, the CPU 171 performs the mechanical initialization routine shown in FIG. 11. Here, the mechanical initialization routine is a process which performs the mechanical initialization process including the CR home seek process, the APG reset, the EJ frame reset, the PF reset, and the like of the printer 11 upon turning on the printer 11. In addition, when the power switch 23 is pushed (i.e., the power-off operation is performed) in the activation state of the printer 11, the CPU 171 performs the power-off process routine shown in FIG. 12.

Here, the CR home seek process is a process of guaranteeing that the carriage 31 returns to the original point in the main scanning direction X and the carriage 31 is movable in the entire movement path. In detail, the home seek process includes a reset operation which sets the original point of the carriage 31 in the main scanning direction by resetting the CR counter 181, and an operation which guarantees that the carriage 31 is movable in the entire movement path in the main scanning direction X without any problem in such a manner that the carriage 31 moves to the opposite home position (eighty digit side) by driving the CR motor 34.

The APG reset is a process of guaranteeing that the carriage 31 returns to the original point in the height direction and the carriage 31 is movable in the entire movement path in the height direction. In detail, first, the power transmission switching device 50 moves to the switching position of selecting the APG device 42, and the PF motor 39 is driven so that the carriage 31 ascends, thereby performing the reset operation of resetting the PG counter 185 at the time point when the carriage 31 comes into contact with the ascending-side end so that the driving current value of the PF motor 39 exceeds the threshold value. Next, the PF motor 39 is driven in the reverse direction so that the carriage 31 descends to the descending-side end on the basis of the count value of the PG counter 185, and the PF motor 39 is driven in the normal direction so that the carriage 31 returns to the maximum ascending position, thereby checking whether the carriage 31 is elevatable in the entire movement path in the height direction without any problem.

In addition, the EJ reset is a process of guaranteeing that the EJ frame 125 returns to the original point in the height direction and the EJ frame 125 is movable in the entire elevation path. In detail, when the carriage engagement portion 108*a* is pushed by a half degree by the carriage 31 by driving the CR motor 34 in the reverse direction in the state where the carriage 31 is located at the maximum ascending position as shown in FIG. 9C, the power transmission switching device 50 is switched to be located at the intermediate position as described above. Subsequently, the lever 126 is manipulated by the carriage 31 by driving the CR motor 34 in the normal direction so that the carriage 31 moves to the eighty digit side. In this lever manipulated state, the PF motor 39 is driven in the normal direction so that the EJ frame 125 ascends. At the time point when the EJ frame 125 comes into contact with the ascending-side end and the driving current value of the PF motor 39 exceeds the threshold value, the EJ counter 186 is reset. Then, after the PF motor 39 is reset, the PF motor 39 is driven in the reverse direction so that the EJ frame 125 descends to the descending-side end on the basis of the count value of the EJ counter 186, thereby checking whether the EJ frame 125 is movable in the entire elevation path without any problem.

Next, the mechanical initialization process and the power-off process performed by the CPU 171 in the printer 11 with such a configuration will be described with reference to the flowcharts in FIGS. 11 and 12. First, the mechanical initialization process will be described.

When the user pushes the power switch 23 of the printer 11 in the stop state, the CPU 171 performs the mechanical initialization routine shown in FIG. 11.

First, in Step S110, the tray pulling flag is reset.

In next Step S20, the home seek process of the carriage 31 is performed.

In next Step S30, the disk detection is performed. That is, the existence of the disk D on the tray 19 is detected. In the state where the tray 19 is located at, for example, the printing standby position, the carriage 31 moves in the main scanning direction X so as to pass through the upper space of the disk placement range of the tray 19 and the light receiving element of the paper sheet width sensor 72 receives light emitted from the light emitting element thereof. In this way, the disk detection is performed.

In Step S40, the existence of the disk is determined. For example, when the output voltage proportional to the intensity of the reflected light received by the paper sheet width sensor 72 exceeds the threshold value (i.e., the reflectivity exceeds the threshold value thereof) on the basis of the degree of the reflectivity detected by the paper sheet width sensor 72, "the disk existence" is determined. In the case of "the disk existence", the current step moves to Step S50, and the tray 19 moves to the set position (media set position).

In next Step S60, the tray pulling flag is set.

In Step S70, it is determined whether the tray open-close switch 26 is manipulated (pushed). Here, the user is prompted to extract the disk D from the tray 19 by moving the tray 19 to the set position. Generally, the user extracts the disk D from the tray 19, and manipulates the tray open-close switch 26 so as to accommodate the tray 19. In addition, the determination process is performed by an interrupt process. In actual, when the push signal of the tray open-close switch 26 is input, the determination process in Step S70 is performed by the interrupt process. For this reason, even when the tray open-close switch 26 is not pushed, the CPU 171 is capable of performing other processes (task or sequence).

When the tray open-close switch 26 is pushed, an operation of pulling the tray 19 is performed. That is, the CPU 171 drives the PF motor 39 in the reverse direction so that the tray 19 is pulled. At this time, the CPU 171 pulls the tray 19 to, for example, the printing standby position on the basis of the count value of the tray position counter 182. In addition, at this time, the tray pulling position may be set to a position where the paper sheet width sensor 72 is capable of detecting the existence of the disk D on the tray 19 when the carriage 31 moves in the main scanning direction X.

Then, when the tray pulling operation ends, the process in Step S10 is performed. That is, the mechanical initialization routine is performed again. That is, the tray pulling flag reset (S10), the CR home seek process (S20), the disk detection (S30), and the disk detection determination (S40) are performed in the same way. At this time, when the disk detection is first performed in Step S30, the disk non-existence is detected. For this reason, the disk existence is determined in the determination in Step S40, and the current step moves to Step S90.

In Step S90, the tray 19 moves to the accommodation position. That is, the CPU 171 drives the PF motor 39 in the reverse direction so that the tray 19 is pulled and transported in the opposite transport direction −Y. In the pulling transport operation, the output signal level of the tray accommodation detector 71 is monitored. When the tray 19 arrives at the accommodation position and the output level of the tray accommodation detector 71 changes from an off state to an on state, the CPU 171 stops the reverse driving operation of the PF motor 39. In this way, the tray 19 is located at the accommodation position.

In next Step S100, the mechanical initialization process is continued. That is, since the CR home seek process of the mechanical initialization process already ends, the other processes of the mechanical initialization process are performed. In detail, the PF reset operation, the paper sheet discharge frame reset operation, the APG reset operation, and the capping, the carriage lock (CR lock), and the like are performed. In addition, although it is not shown in the example of FIG. 11, an insertion state check of the ink cartridge 28, a measurement process (parameter setting) of the CR motor 34, and the like are included in the mechanical initialization process. Each ink cartridge 28 includes a terminal which is electrically connected to a cartridge-holder-side terminal for permitting an access of the CPU 171 of the printer 11 in the case where the ink cartridge 28 is inserted into the cartridge holder, and a CSIC (Customer Service IC). In order to read various ink information (a serial number, color information, an ink remaining amount (or an ink consumed amount), and the like) from the memory of the CSIC, the CPU 171 tries to access to the memory. If the access is successfully performed, it is determined that the ink cartridge 28 is an inserted state. Additionally, in the measurement process of the CR motor 34, the CR motor 34 is driven so as to measure a motor load caused by a sliding resistance during the movement of the carriage 31 at the set speed profile, and a motor driving parameter (for example, a PWM (Pulse Width Modulation) control duty ratio or the like) in accordance with the measured motor load is set in order to handle a variation in age of the sliding resistance. Further, the capping and the CR lock indicates an operation of releasing the capping state upon moving the carriage 31 from the home position or maintaining the capping state when the carriage 31 returns to the home position.

When the mechanical initialization process ends in this way, in next Step S110, the initialization end flag is set. In this way, the mechanical initialization routine ends. In addition, a timing at which the user manipulates the power switch 23 in order to turn off the printer 11 may be before the mechanical initialization end (during the mechanical initialization routine) or after the mechanical initialization end.

Next, the power-off process routine will be described with reference to FIG. 12. When the user pushes the power switch 23 in the activation state of the printer 11 and inputs the push signal of the power switch 23, the CPU 171 performs the power-off process routine.

First, in Step S210, it is determined whether the mechanical initialization ends. That is, the CPU 171 determines whether the initialization end flag is "SET". When the mechanical initialization ends, the current step moves to Step S220, and the mechanical end process is performed. Here, the mechanical end process indicates a mechanical operation including an operation of moving the tray 19, the carriage 31, the EJ frame 125, the cap 45, or the like to a predetermined position. When the mechanical end process normally ends, for example, the tray 19 is located at the accommodation position, the carriage 31 is located at the home position and the maximum ascending position (reset position), the EJ frame 125 is located at the maximum ascending position (reset position), and the cap 45 is located at the capping position (ascending position).

Further, even in the mechanical end process, the existence of the disk D on the tray 19 is determined. When the disk D exists on the tray 19, the user is prompted to extract the disk D from the tray 19 by moving the tray 19 to the set position. Then, the user extracts the disk D from the tray 19, and the tray 19 moves to the accommodation position. Then, the mechanical end operation is performed so as to turn off the printer 11 (Step S250). In addition, when the tray 19 is located at the accommodation position in the case where the disk does not exist on the tray 19, the mechanical end operation is performed so as to turn off the printer 11. On the other hand, when the tray 19 is not located at the accommodation position, the tray 19 moves to the accommodation position, and the mechanical end process is performed. After the mechanical end process ends, the printer 11 is turned off (Step S250).

Meanwhile, when the mechanical initialization does not end as a result of the determination process in Step S210, the current step moves to Step S230, and it is determined whether the tray pulling flag is "SET". When the tray pulling flag is "SET", in the mechanical initialization process routine upon turning on the printer 11, the disk existence is detected (Yes in Step S40), which means the fact that the printer 11 is turned off in the state where the tray 19 moves to the set position so as to extract the disk from the tray 19 (S50). For example, in the case where the tray open-close switch 26 is manipulated after the tray 19 moves to the set position, the tray pulling flag is rest after the tray pulling operation (S10). For this reason, when the tray pulling flag is "SET", in most of cases, the tray 19 is located at the set position.

Then, when the tray pulling flag is "SET", the current step moves to Step S240, and the tray pulling operation is performed. The tray pulling operation at this time is performed in the same way as the process operation in Step S80. In this way, in the case where the printer 11 is turned off before the mechanical initialization ends, the printer 11 is turned off in the state where the tray 19 is pulled to the printing standby position to be located at the printing standby position (Step S250). Here, the fact that the tray pulling flag is "SET" guarantees the movement path of the tray 19 when the tray 19 moves from, for example, the printing standby position to the set position upon turning on the printer 11. For this reason, since it is possible to guarantee that an obstacle such as the carriage 31 or the EJ frame 125 does not exist on the movement path of the tray 19, it is possible to perform the operation of pulling the tray 19 without any problem even when the mechanical initialization has not yet ended.

On the other hand, the tray pulling flag is "RESET", the printer 11 is turned off in the state where the tray 19 is located at the current position (Step S250). Here, the case where the tray pulling flag is "RESET" indicates the case where the mechanical initialization process is continuously performed (S100) and an error is generated during the mechanical initialization process. In this case, since at least one of the carriage 31 and the EJ frame 125 may be located at a position (position except for the maximum ascending position) where one of them interferes with the tray 19, it is not possible to guarantee the movement path of the tray 19. In this state, when the tray 19 is pulsed, the carriage 31 or the EJ frame 125 may come into contact with the tray 19. For example, when the tray 19 comes into contact with the printing head 35 or the EJ frame 125, a problem arises in that the printing head is damaged or the nozzle formation surface is rubbed to thereby mix the ink inside the nozzle with ink of different color. Also, when the disk D exists on the tray 19, the disk D may be damaged. For this reason, the operation of pulling the tray 19 is not performed. However, since the tray 19 is basically located at the accommodation position during the mechanical initialization, in most of cases, the printer 11 is turned off in the state where the tray 19 is located at the accommodation position.

Further, in the embodiment, Step S30 corresponds to a detection step, Step S40 and Step S50 correspond to a tray moving step, and Step S60 corresponds to a storage step. In addition, Step S210 corresponds to a first determination step, Step S230 corresponds to a second determination step, and Step S250 corresponds to a power-off step.

As described above, according to the embodiment, the following advantages are obtained.

(1) Since the tray 19 is pulled when the tray pulling flag is "SET" upon performing the power-off process, it is possible to turn off the printer 11 in the state where the tray 19 is accommodated.

(2) Since the operation of pulling the tray 19 is performed when the initialization end flag is "RESET" and the tray pulling flag is "SET", it is possible to prevent the operation of pulling the tray 19 in the case where an error is generated during the mechanical initialization process. Accordingly, it is possible to prevent the operation of pulling the tray 19 in the circumstance in which the movement path of the tray 19 is not guaranteed since at least one of the carriage 31 and the EJ frame 125 is located at the height position interfering with the tray 19 as in the case where the user turns off the printer 11 due to the error generated during the mechanical initialization process.

(3) In the case of the disk non-existence in the mechanical initialization process, the mechanical initialization process is continued by moving the tray 19 to the accommodation position. Accordingly, it is possible to perform the mechanical initialization process in the circumstance in which a part of the tray 19 does not exist in the elevation path of the EJ frame 125 and the elevation path and the X-direction movement path of the carriage 31. In addition, since the other processes of the mechanical initialization process except for the CR home seek process are performed when the disk non-existence is detected, it is possible to efficiently perform the mechanical initialization process without additionally performing the CR home seek process required to be performed before the disk detection operation. For example, when the process of prompting the user to extract the disk from the tray 19 and the mechanical initialization process are respectively included in different routines, the CR home seek process has to be repetitively performed in each of the different routines. However, in the routine according to the embodiment, it is possible to efficiently perform the process routine without the repetitive process.

(4) When the disk D is placed on the tray 19 upon turning on the printer 11, the tray 19 moves to the set position. Even when the printer 11 is turned off without extracting the disk D from the tray 19, the printer 11 is turned off after accommodating the tray 19 in the printer 11. Accordingly, it is possible to prevent the case where the guide arms 19L and 19R of the tray 19 located at the set position in the power-off state of the printer 11 are nipped by of the pair of transport rollers 40 for a long period of time. For this reason, it is possible to prevent the undesirable case where a load of the tray 19 is concentrated on two local positions of the driven roller 40*b* of the pair of transport rollers 40 nipping the guide arms 19L and 19R so that the shaft of the driven roller 40*b* is bent in a curved state. Accordingly, since the tray 19 is accommodated in the printer 11, the pair of transport rollers 40 nips the comparatively wide tray body 19*a* of the tray 19, thereby suppressing the load applied to both the tray 19 and the pair of transport rollers 40 to be comparatively small.

The above-described embodiment is not limited to the above description, but may be modified into various forms as below.

Modified Example 1

A detection section for detecting the existence of the disk on the tray may be a sensor which is fixed onto the tray or a sensor which is provided on the apparatus body so as to detect the existence of the disk on the tray, for example, in the state where the tray is located at the printing standby position. With such a configuration, since it is not necessary to move the carriage 31 upon detecting the existence of the disk, it is not necessary to perform the home seek process before detecting the existence of the tray. That is, instead of the configuration in which the disk is detected during the initialization process (after the CR home seek process), a configuration may be adopted in which the disk detection is performed before performing the initialization process (CR home seek process).

Modified Example 2

The accommodation position of the tray 19 upon turning off the printer 11 may be a position where the front end portion of the tray 19 slightly protrudes from the discharge portion 18 as long as the wide tray body 19*a* of the tray 19 is nipped by the pair of transport rollers 40.

Modified Example 3

The tray 19 includes the extension movement mechanism 77 having the pair of foldable guide arms 19L and 19R, but a square-plate-shaped tray disclosed in, for example, JP-A-2005-59584 may be adopted.

Modified Example 4

The tray pulling flag and the initialization end flag as information stored in the storage section is not limited to information of one bit such as a flag. For example, the information may be data of two bits or more. Further, the storage section is not limited to the RAM, but may be a register.

Modified Example 5

In the above-described embodiment, the tray is used to place a printing medium (first rigid printing medium) as the disk D thereon, but may be used to set a printing medium (second soft printing medium) as the paper sheet thereon. In addition, the printing medium to be set on the tray may be a resinous film, a metallic film, a cloth, a film substrate, a resinous substrate, or the like.

Modified Example 6

The invention may be applied to a label-printing-purpose printing apparatus which does not include a transporter for transporting a second printing medium such as a paper sheet.

Modified Example 7

The method of performing the mechanical initialization process and the power-on process is embodied by software of a program executed by the CPU 171, but may be embodied by hardware. For example, the mechanical initialization process and the power-on process may be performed by an integrated circuit such as an ASIC (Application Specific IC). Further, the mechanical initialization process and the power-on process may be performed by the combination of the software and the hardware.

Modified Example 8

The printing apparatus is not limited to the serial printer, but may be a line printer or a page printer. In addition, the type of the printer is not limited to the ink jet printer, but may be a dot-impact printer, a thermal printer, a laser printer, or the like.

The technical spirit obtained by the embodiment and the modified examples will be described as below.

(1) The printing apparatus according to the first aspect is provided, the printing apparatus further includes: a transport section which transports a second soft printing medium (P) as the printing medium; a common power source (39) which drives the tray and the transport section; printing sections (31 and 35) which perform a printing process on a first printing medium and the second printing medium; and a position detecting section (70) which is provided at a position capable of detecting the tray and the second printing medium, wherein the tray is used to set the first rigid printing medium (D) as the printing medium thereon, wherein a movement path of the tray and a transport path of the second printing medium using the transport section are joined at a position right before the printing section so as to form a common path, and wherein the initialization process includes a discharge reset operation of driving the power source so as to perform a discharge operation using the transport section and checks whether the transport path is empty after the discharge operation on the basis of a detection result of the position detecting section.

(2) The printing apparatus according to the first aspect is provided, the printing apparatus further including: a gap adjusting section (42) which moves the printing section so as to adjust a gap between the printing section and the printing medium, wherein the initialization process includes a gap adjusting section reset operation of retreating the printing section to an end position so as not to interfere with the tray.

(3) The printing apparatus according to the first aspect is provided, the printing apparatus further including: a discharge opening adjusting section (127) which moves a movable member (125), adjusting a height of a discharge opening used to discharge the printing medium having been subjected to the printing process of the printing sections, in a thickness direction of the printing medium, wherein the initialization process includes a discharge opening adjusting section reset operation of retreating the movable member to an end position so as not to interfere with the tray.

What is claimed is:

1. A printing apparatus that includes a tray for setting a printing medium thereon, the printing apparatus comprising:

a switch section that is used to perform a power-on operation or a power-off operation;

a tray driving section that performs a driving operation of extracting the tray;

a detection section that detects whether the printing medium exists on the tray;

a control section that moves the tray to a discharge position by controlling the tray driving section in order to prompt an operation of extracting the printing medium from the tray before an initialization process ends when the printing medium is detected upon performing a power-on process; and a storage section that stores information that the control section moves the tray to the discharge position upon performing the power-on process, wherein the control section determines whether the tray moves to the discharge position upon performing the power-on process on the basis of the information stored in the storage section when the power-off operation is detected before the initialization process ends so as to interrupt a power supply in the state where the tray is located at a current position when the tray does not move to the discharge position upon performing the power-on process or to interrupt the power supply after accommodating the tray in the printing apparatus by controlling the tray driving section when the tray moves to the discharge position upon performing the power-on process, and wherein the control section determines whether the initialization process ends upon performing the power-off process and pulls the tray by controlling the tray driving section if it is determined that the tray moves to the discharge position upon performing the power-on process on the basis of the information stored in the storage section even when the initialization process has not yet ended.

2. The printing apparatus according to claim 1, further comprising:

a printing section that is adapted to be movable in a direction intersecting a movement path of the tray in order to perform a printing process on the printing medium; and a printing driving section that performs a driving operation of moving the printing section, wherein the detection section is provided in the printing section, and wherein the control section performs a home seek process of the printing section among the initialization process by controlling the printing driving section upon performing the power-on process and performs a detection operation of detecting the existence of the printing medium on the tray using the detection section by moving the printing section after the home seek process so as to accommodate the tray in the printing apparatus by controlling the tray driving section when the printing medium does not exist on the tray as a result of the detection operation using the detection section and to continue the initialization process after accommodating the tray in the printing apparatus.

3. The printing apparatus according to claim 1, further comprising:

a manipulation section that is used to extract the tray, wherein whenever the manipulation section is manipulated to accommodate the tray moved to the discharge position in the printing apparatus, the tray is accommodated in the printing apparatus and the power-on process is repeated.

4. The printing apparatus according to claim 1, wherein the control section interrupts the power supply in the state where the tray is located at the current position if it is determined that the initialization process has not yet ended upon performing the power-off process and the tray does not move to the discharge position upon performing the power-on process on the basis of the information stored in the storage section.

5. The printing apparatus according to claim 1, wherein when the initialization process ends, the control section performs an end process including an operation of accommodating the tray in the printing apparatus in the case where the tray is located at the discharge position.

6. A tray control method of a printing apparatus that includes a tray for setting a printing medium thereon, the tray control method comprising:

a detection step of detecting whether the printing medium exists on the tray upon performing a power-on process;

a tray moving step of moving the tray to a discharge position in order to prompt an operation of extracting the printing medium from the tray before an initialization process ends when the printing medium exists on the tray as a result of the detection step;

a storage step of storing information that the tray moves to the discharge position upon performing a power-on process, wherein the information is stored in a storage section;

a first determination step of determining whether the initialization process ends when a power-off operation is detected;

a second determination step of determining whether the tray moves to the discharge position upon performing the power-on process on the basis of the information stored in the storage section if the initialization process has not yet ended;

a power supply interrupting step of interrupting a power supply in the state where the tray is located at a current position when the tray does not move to the discharge position upon performing the power-on process or interrupts the power supply after accommodating the tray in the printing apparatus when the tray moves to the discharge position upon performing the power-on process; and a third determination step of determining whether the initialization process ends upon performing the power-off process and pulling the tray by controlling a tray driving section that performs a driving operation of extracting the tray if it is determined that the tray moves to the discharge position upon performing the power-on process on the basis of the information stored in the storage section even when the initialization process has not yet ended.

* * * * *